US007578611B2

(12) United States Patent
Hamilton

(10) Patent No.: US 7,578,611 B2
(45) Date of Patent: Aug. 25, 2009

(54) STIRRER TOOL WITH RADIALLY AND DISTALLY EXTENDING FLEXIBLE PROJECTIONS

(76) Inventor: Ralph Hamilton, 203 Deer Run La., Stevensville, MD (US) 21666

( * ) Notice: Subject to any disclaimer, the term of this patent is extended or adjusted under 35 U.S.C. 154(b) by 0 days.

(21) Appl. No.: 12/364,159

(22) Filed: Feb. 2, 2009

(65) Prior Publication Data

US 2009/0135668 A1 May 28, 2009

Related U.S. Application Data

(63) Continuation-in-part of application No. 11/520,770, filed on Sep. 14, 2006, now Pat. No. 7,484,879.

(60) Provisional application No. 60/726,171, filed on Oct. 14, 2005.

(51) Int. Cl.
*B01F 7/16* (2006.01)

(52) U.S. Cl. ..... 366/129; 366/325.2; 366/326.1; 366/347; 366/605; 416/240

(58) Field of Classification Search ..... 366/64–67, 366/96–98, 102–104, 242–252, 279, 308, 366/342–343, 129, 347, 605, 325.1, 325.2, 366/326.1, 329.1, 329.2, 331; 99/323.5, 99/348; 416/132 R, 227 R, 231 A, 240, 241 A, 416/227 A, 230; 7/114; 172/378, 379, 381
See application file for complete search history.

(56) References Cited

U.S. PATENT DOCUMENTS 335,739 A 2/1886 Brammer et al.

(Continued)

FOREIGN PATENT DOCUMENTS

DE 3321532 A1 12/1984

(Continued)

OTHER PUBLICATIONS

Alibaba.com, Paint Mixers, Hangzhou John Industry and Trade, Products, Apr. 27, 2005, pp. 1-3, http://john-tools.en.alibaba.com/group/50048360/Paint_Mixers.html.

(Continued)

*Primary Examiner*—Charles E Cooley
(74) *Attorney, Agent, or Firm*—Miles & Stockbridge P.C.; David R. Schaffer, Esq.

(57) ABSTRACT

Embodiments of the present invention are directed to a stirrer tool that includes a head component having a first body portion and a second body portion connected to the first body portion with a first plurality of projections extending substantially radially out from and substantially perpendicular to a longitudinal axis of a body portion. Head component may also have a second plurality of projections extending in a substantially distal direction away from a distal end of the body portion, and all of the projections may be made of a substantially stiff material that is flexible enough to be bent to fit through an opening in a container that is smaller in diameter than a diameter of the head component and stiff enough to mix viscous products. The system may further include an elongate shaft, which may be coaxially aligned with and a distal end of the elongate shaft may be attached to the head component and the proximal end of the elongate shaft may be configured to be removably held in a device to rotate the elongate shaft.

29 Claims, 28 Drawing Sheets

U.S. PATENT DOCUMENTS 368,233 A 8/1887 Phelps et al.
830,336 A 9/1906 Lake
843,136 A 2/1907 Dicks
869,876 A 11/1907 Borden
871,906 A 11/1907 Avery et al.
929,229 A 7/1909 Klick
941,948 A 11/1909 Rees
955,978 A 4/1910 Mitchell
973,554 A 10/1910 Pearson
1,420,537 A 6/1922 Flory
1,438,716 A 12/1922 Orzchovski
1,616,817 A 2/1927 Maxwell
1,689,277 A 10/1928 Burns
2,278,398 A 3/1942 Wittmann
2,501,016 A 3/1950 Woodman
2,546,285 A 3/1951 Wittmann
2,580,132 A 12/1951 Seymour
2,584,202 A 2/1952 Harp, Sr.
2,659,581 A 11/1953 Gray
2,670,938 A 3/1954 Wittmann
2,799,485 A 7/1957 Silverman
2,896,926 A 7/1959 Chapman
2,898,094 A 8/1959 O'Neill, Jr.
2,932,494 A 4/1960 Wales
3,166,303 A 1/1965 Chapman
3,186,020 A 6/1965 Redfield
3,319,940 A 5/1967 Mentnech
3,326,533 A 6/1967 Sturrup
3,332,669 A 7/1967 Colonna
3,333,831 A 8/1967 Chapman
3,455,540 A 7/1969 Mercmann
3,559,962 A 2/1971 Enssle et al.
3,733,645 A 5/1973 Seiler
3,796,512 A 3/1974 Djuvik
3,972,512 A 8/1976 Grisé et al.
3,991,983 A 11/1976 Drynan
4,004,789 A 1/1977 Belas et al.
4,049,243 A 9/1977 Kramer
4,054,272 A 10/1977 Cooke
4,057,226 A 11/1977 de Mos et al.
4,065,107 A 12/1977 Van Horbek
4,260,267 A 4/1981 Walton
4,396,291 A 8/1983 Simmonds
4,422,770 A 12/1983 Geible
4,444,510 A 4/1984 Janssen
4,506,989 A 3/1985 Reh
4,538,922 A 9/1985 Johnson
4,547,126 A 10/1985 Jackson
4,552,461 A 11/1985 Ott et al.
4,591,389 A 5/1986 Everitt
4,601,583 A 7/1986 Amorese
D290,084 S 6/1987 Klapperich
4,693,610 A 9/1987 Weiss
4,722,608 A 2/1988 Salzman et al.
4,819,736 A 4/1989 Hedgepeth
4,884,895 A 12/1989 Rodgers
D306,685 S 3/1990 Nadeau
4,924,444 A 5/1990 Castellanos
D309,400 S 7/1990 Barnard
5,037,210 A 8/1991 Bliss
5,073,033 A 12/1991 Klepeis
5,090,816 A 2/1992 Socha
5,192,131 A 3/1993 Hatfield
5,198,156 A 3/1993 Middleton et al.
D334,577 S 4/1993 Wheat
5,257,435 A 11/1993 Brewster
5,402,548 A 4/1995 Adair et al.
5,403,091 A 4/1995 Thomas
5,417,493 A 5/1995 Ericson
5,437,400 A 8/1995 Loeffler
5,439,289 A 8/1995 Neilson
D366,596 S 1/1996 Hewin
5,482,367 A 1/1996 Khan et al.
5,533,802 A 7/1996 Garganese
5,615,543 A 4/1997 Caffey et al.
5,630,666 A 5/1997 Rodriguez
5,676,463 A 10/1997 Larsen
5,688,048 A 11/1997 Duckworth
5,716,132 A 2/1998 Chou
D392,523 S 3/1998 Alworth
5,842,784 A 12/1998 Contrasto
5,909,778 A 6/1999 Acosta et al.
5,938,325 A 8/1999 Edwards
5,979,064 A 11/1999 Kitz et al.
D421,030 S 2/2000 Panaccione et al.
6,032,442 A 3/2000 Paolo
6,068,395 A 5/2000 Ondracek
6,071,006 A 6/2000 Hochstein et al.
6,089,748 A 7/2000 McDermott et al.
6,200,015 B1 3/2001 Gartz et al.
D440,476 S 4/2001 Del Gaone
6,247,837 B1 6/2001 Wardberg
6,264,356 B1 7/2001 Börner
6,325,532 B1 12/2001 King et al.
6,394,640 B1 5/2002 Astegno et al.
6,454,455 B1 9/2002 Jungvig
6,536,535 B1 3/2003 Washek
6,558,035 B2 5/2003 Lane
6,616,318 B1 9/2003 LeBlanc et al.
6,616,323 B2 9/2003 McGill
6,634,785 B2 10/2003 French et al.
D484,657 S 12/2003 Scolley et al.
6,676,285 B2 1/2004 Qureshi
6,688,764 B2 2/2004 King
6,712,498 B1 3/2004 Yang
6,712,499 B2 3/2004 Frank, Jr.
6,764,704 B2 7/2004 Schub
6,830,369 B2 12/2004 Haughton et al.
6,848,823 B2 2/2005 King et al.
6,863,430 B2 3/2005 Berube
6,902,315 B2 6/2005 Hutchinson
6,955,227 B1 10/2005 Motosko
D512,292 S 12/2005 Martin
7,451,832 B1 * 11/2008 Delvo ..... 172/25
7,473,026 B2 * 1/2009 Clawson et al. ..... 366/347
7,484,879 B2 * 2/2009 Hamilton, Jr. ..... 366/129
7,513,678 B2 * 4/2009 Venus ..... 366/129
2002/0015357 A1 2/2002 Langevin, Jr. et al.
2005/0047268 A1 3/2005 Chen
2005/0047269 A1 3/2005 Chen
2005/0052947 A1 3/2005 Claussen et al.
2005/0088907 A1 4/2005 Vanek
2007/0086271 A1 * 4/2007 Hamilton ..... 366/325.2
2008/0247267 A1 * 10/2008 Clawson et al. ..... 366/347

FOREIGN PATENT DOCUMENTS

DE 3321532 A1 * 12/1984

OTHER PUBLICATIONS

Dynamix Agitators, Paint Mixers, Chemical Mixers and Mixing Tanks, Paint and Chemical Mixer, Apr. 27, 2005, p. 1, http://www.dynamixinc.com/.

Red Devil, Inc., Painter's tools, sealants, caulk, home repair tools, Paint Mixers, Apr. 27, 2005, p. 1, http://www.reddevil.com/products.cfm?c=pt&cat=15.

Acme Hardware.com, Red Devil 4006 5g Paint Mixer, Product Detail, Apr. 27, 2005, pp. 1-2, http://acmehardware.com/product_detail.aspx?sku=6141337.

Corner Hardware.com, Drill Powered Paint Mixers, ShurLine 1 Gal. Paint Mixer, Apr. 27, 2005, p. 1, http://www.cornerhardware.com/item_264689/Shur-Line/Shur-Line/ShurLine-1-Gal-Paint.

Do It Yourself.com, Shop for Power Driven Mixer by Hyde Tools, Apr. 27, 2005, p. 1, http://doityourself.com/store/6576144.htm.

Highland Laboratories, Mixers, Dispensers, Tinters, Blenders And Paint Colorant Shakers & Conditioners, Paint Products: 5 Gallon Dual Axis Multi-Mix Mixer/500, Apr. 27, 2005, pp. 1-2, http://www.highlandlabs.com/Paint/model500.htm.
Finish Systems, Painting Accessories, Paint Shakers, Apr. 27, 2005, pp. 1-4, http://www.finishsystems.com/paintshakers.html.
Tools USA, 8779 Tools USA & Equipment Company, automotive supplies, lifts, Paint booths for sale, Paint Supplies, Blair Tornado Electric Shaker, Apr. 27, 2005, pp. 1-3, http://www.toolusa.com/cgi-bin/sgin0101.exe?T1=PBE+BSS+4856&GENB=ps&GENO=.
HarboFreight.com Harbor Freight Tools—Quality Tools at the Lowest Prices, Pneumatic Paint Shaker, Apr. 27, 2005, pp. 1-3, http://www.harborfreight.com/cpi/ctaf/Displayitem.taf?itemnumber=422.
Jamestown Distributors, Boatbuilding and Woodworking Supplies, Tornado II Paint Shaker, Portable, Apr. 27, 2005, pp. 1-2, http://www.jamestowndistributors.com.ak/Paint_Supplies/paint_Shaker_fam/index.html.
Machine Mart, Power Tools, Power Tools & Machinery, Machine Mart No. 1 for Power Tools, Clarke CHT490 Paint Mixing Paddle, Apr. 27, 2005, pp. 1-2, http://www.machinemart.co.uk/product.asp?p=040219490&&r=2150&g=119.
PCT/US2006/038771—International Search Report dated Jul. 27, 2007.
U.S. Appl. No. 11/520,770—Notice of Allowance dated Oct. 2, 2008.

* cited by examiner

STIRRER TOOL WITH RADIALLY AND DISTALLY EXTENDING FLEXIBLE PROJECTIONS

CROSS-REFERENCE TO RELATED APPLICATION

This application is a Continuation-in-Part of U.S. Pat. No. 7,484,879, dated Feb. 3, 2009, which claims the benefit of and priority to U.S. Provisional Patent Application No. 60/726,171, filed on Oct. 14, 2005, both of which are hereby incorporated herein in their entireties.

FIELD OF THE INVENTION

The present invention relates generally to stirrer tools, and more particularly to stirrer tools for mixing a variety of products having various viscosities, sedimentation, and/or levels of separation of different constituent parts of the product.

BACKGROUND

In the course of using paints, putties, co-mixed liquids, and other products that tend to separate into different layers of their constituent materials (for example, paint, wall-board mud, and the like) it is often necessary to remix the products. To do this completely it is necessary to physically reach the bottom of the container in which the product is stored to ensure any sediment that may have settled there is mixed back into the product as well as combine new materials together in the course of preparing for their application. To make sure the remixing is as complete as possible, it is necessary to be able to reach the corners of the container defined by the junction of a bottom and sides of the container. To do this without the use of large, heavy and expensive equipment has resulted in the development of alternative and portable devices for mixing these products. Unfortunately, currently available devices work in only one or two specific ways. For example, some are specifically designed to reach the bottom and/or corner of a container to stir up and then mix in sediment deposited there, some have multiple and multi-level projections, some are collapsible, some rely on a creating a vortex in the product, some are flexible enough to be inserted into and removed from a container through a small opening, a small few may be temporarily and/or permanently varied in their size and/or shape, and many are made of hard materials that frequently damage the container in which they are being used. In addition, the use of hard materials, for example, inflexible metal wire, restricts the size or length of the mixing head and, as a result, the action does not provide sufficient static to create a vortex or velocity to stir products and/or paints completely. However, none provide the functionality from all of the above features and characteristics.

As a result, what is needed is a stirrer tool that can reach the bottom and/or corner of any container, has multiple and multi-level projections that are collapsible to be able to be inserted into a container through an opening smaller than the circumference of the stirrer tool, uses a vortex mixing action in conjunction with a dispersion ability, and that can be temporarily and/or permanently varied in its configuration, size and/or shape, and be made of materials of sufficient strength to dislodge and disrupt materials or sediment and that will not damage the container in which it is being used.

DETAILED DESCRIPTION

Figure 1:
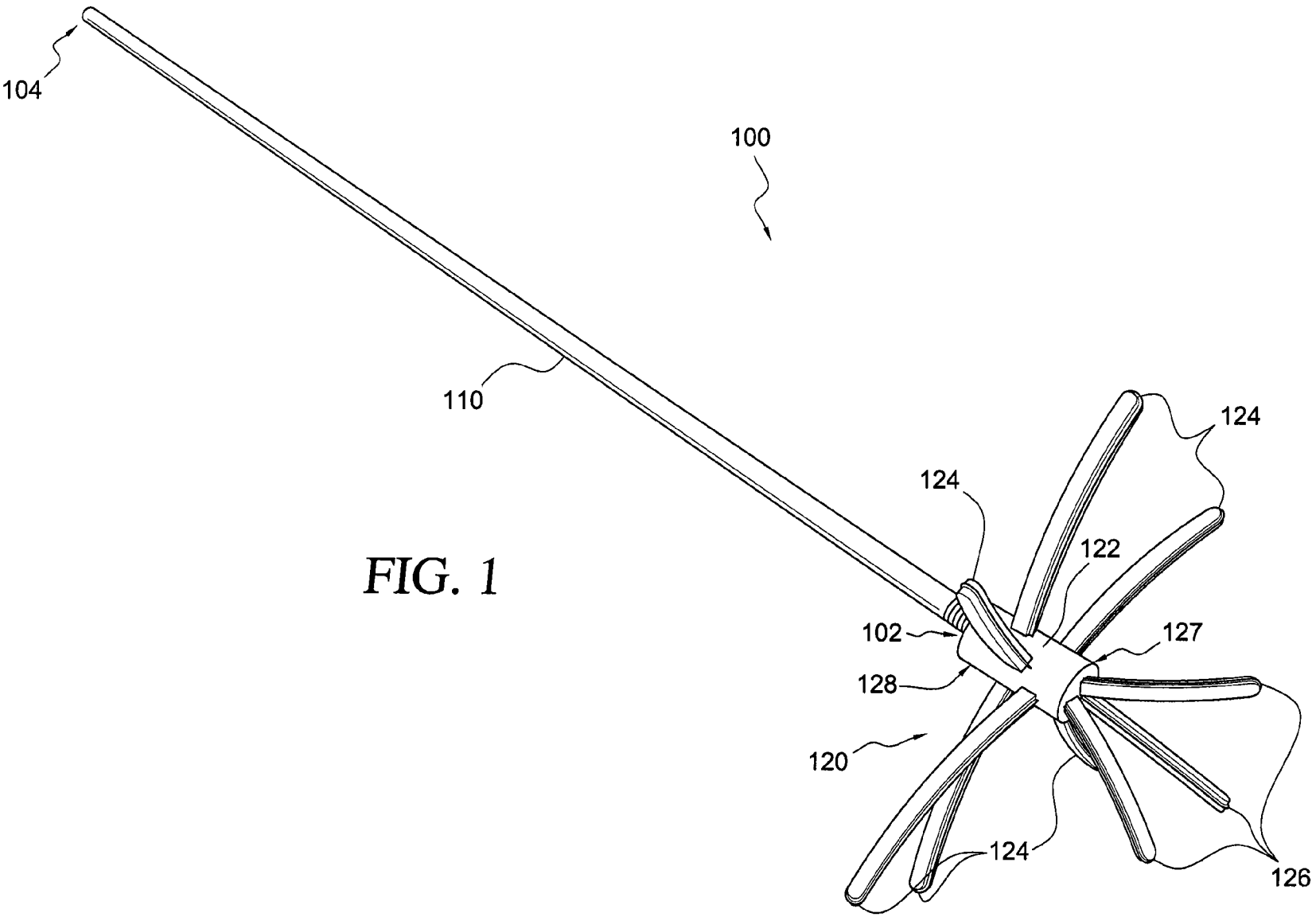
FIG. 1 is a side perspective view of a stirrer tool showing an assembled unit including a stirrer head and rod, in accordance with an embodiment of the present invention.

The present invention is described in relation to exemplary embodiments shown in the figures. It should be appreciated, however, that the embodiments shown are exemplary and other configurations and arrangements of the present invention may be apparent to those of ordinary skill in the applicable arts.

In accordance with an embodiment of the present invention, a stirrer tool may include (e.g., comprise) a head component including a body portion having a longitudinal axis, a first plurality of projections extending substantially radially out from an outer surface of the body portion and being substantially perpendicular to the longitudinal axis of the body portion, and a second plurality of projections extending in a substantially distal direction away from a distal end of the body portion. The projections may be made of a substantially stiff material that is flexible enough to be bent to fit through an opening in a container that is smaller in diameter than a diameter of the head component defined by outer ends of the first plurality of projections and stiff enough to mix viscous products. Each of the first and second projections may be shortened by cutting-off a selected length of the projection, and the first plurality of projections may be configured to provide a vortex mixing action and the second plurality of projections configured to reach and stir up sediment on bottoms and in corners in containers. The stirrer tool may further include an elongate shaft including a distal end and a proximal end, the elongate shaft being coaxially aligned with and the distal end of the elongate shaft being attached to the head component and the proximal end of the elongate shaft may be configured to be removably held in a device to rotate the elongate shaft, for example, but not limited to, a drill.

In accordance with one or more embodiments of the present invention, by constructing a head unit with a substantially rigid, cylindrical body, for example, a hard plastic, composite or metal, and a relatively thick yet flexible material, for example, but not limited to, a monofilament from a grass whip or an injection molded plastic and/or plastic compound, a large head unit may be obtained that can achieve the velocity to produce a stirring action sufficient to mix heavy and or thick liquids and/or products. In addition, the head is flexible enough to be inserted into and removed from a container through an opening in the top of the container that is smaller than the diameter of the head unit. To do this, "fingers" of the flexible material, for example, but not limited to, a monofilament and/or injection molded finger having a diameter ranging from about $1/16^{th}$ of an inch to about $3/16^{th}$ of an inch or more depending on the material to be mixed, are attached to and extend away from the substantially cylindrical body in a configuration that enables the head unit to be used to dig out tough sediment that had settled in the bottom of the container. In some embodiments, each of the fingers may be ½ inch in diameter, but as the diameter of the fingers increases, so does the size of the head unit, which generally means that a more powerful device will likely be required to rotate the head unit and the elongate shaft at speeds sufficient to adequately mix the desired liquid, product, and/or material. Numerous arrangements and/or configurations of the monofilament fingers are possible and, in general, the fingers extend outwardly from and into the x, y and z planes around the substantially cylindrical body. In some embodiments each finger has a substantially identical and opposite finger located substantially 180° away on the other side of the body of the head unit. In other embodiments, one or more sets of three or more fingers may be arranged substantially evenly spaced around the body of the head unit such that each set is in a single plane and at different levels and heights along the body and substantially perpendicular to the body of the head unit. In some embodiments, each finger may have a substantially rounded, oval, and/or oblong shape. In still other embodiments, each finger may have a substantially triangular, square, and/or other polygonal shape with sharp edges, which may result in improved stirring and mixing performance.

The head unit may be adapted to receive and/or be attached to one end of a rod that is adapted, at its other end, to be inserted into and held in a device for rotating the rod, for example, but not limited to, a drill chuck. For example, in one embodiment, the rod may be a ¼" rod that has male threads at one end and fits into and may removably engage a female threaded portion in the head that was tapped with a corresponding thread to engage and receive the male threads of the rod.

Because of the flexible nature of the monofilament fingers, in accordance with one or more embodiments of the present invention, the head unit may be inserted into and retrieved from various sizes and shapes of containers, essentially, regardless of the sized and/or configuration of their openings. In general, the head unit may be used with openings that have internal diameters less than the outer diameter of the head unit, as defined by the length of the longest finger(s), and slightly larger than the diameter of the body of the head unit. In general, if the container has an opening made from an inflexible and/or non-expandable material, e.g., metal, the smallest opening that the head unit can fit through is the diameter of the body of the head unit plus two times the cross-sectional diameter of the fingers on the body. If the opening in the container is made of an expandable material, the opening can be smaller than the non-expandable opening, and will be limited by the maximum size to which the opening can expand.

In accordance with one or more embodiments of the present invention, the body portion of the head unit may be mass-produced using a plastic and/or composite injection molding process to produce the body portion of the head unit. In some embodiments, the body portion and finger assembly may be made as a one-piece plastic injection molded part with a threaded female opening at the base to accept a threaded male rod or shaft. In still other embodiments, the body portion may be made with a plurality of openings to receive the monofilament, a rod channel defined by an opening at an end of the body portion, and, optionally, a channel running from and defined by an opening in an exterior surface of the body and to an opening on a wall of the rod channel to receive a set screw that can be screwed in toward the rod channel to engage and hold the head unit in place on the rod. In general, the head units are designed to be used multiple times and finally disposed of at the end of their useful life. However, in some instances it may be necessary to discard the head unit after a single use, for example, but not limited to, when mixing toxic and/or hazardous/biohazardous materials. The strength and potential useful life of the stirrer tool may be extended by making the body out of a sturdier material, for example, a metal such as steel, cast iron, etc., and that, while it would likely be heavier, it would function exactly the same as the lighter-duty materials. While the metal body portion may be formed from casting, shaping and cutting rod stock, and/or by cutting pre-shaped rod stock, it may or may not be possible or economically reasonable to have preformed openings in the body portion for the fingers. Instead, as is also possible with plastic and/or composite body portions, the openings may be drilled and/or threaded after the body portion is made. In this way the fingers may be affixed to the body portion by, for example, gluing monofilament fingers into the openings, placing the body portion into a mold and injection molding the fingers into the openings, threading an end of the monofilament fingers and then screwing the threaded end into cooperatively threaded openings. Regardless of which material is used to make the body portion of the head unit (for example, plastic, composite, metal or other material), it will generally be impervious to paint thinners, solvents and/or to any of the other materials to be mixed.

In accordance with one or more embodiments of the present invention, in general, the body portion of the head unit may include (e.g., comprise) a longer length than diameter to allow for a number of co-planar arrangements of projections, that is, the fingers, which may be spaced in different positions around the body portion of the head unit. The body portion may have a longitudinal axis. Examples of possible arrangements include, for example, two fingers in balanced opposing positions on a plane perpendicular to the length of the body portion and/or at different levels along the body portion of the head unit. However, various offset and unbalanced configurations are contemplated as these configurations may provide benefits in mixing liquids with and/or without sedimentation.

In accordance with one or more embodiments of the present invention, at a finger end of the body portion opposite from the end with the rod channel, additional monofilament fingers may project at equal and/or varying angles from the end opposite the end with the rod channel. These fingers, in general, will be of equal length, but shorter than the fingers that project from the side of the body portion, and will be spaced around the finger end of the body portion at substantially equal distances apart from each other and at substantially the same angles from a longitudinal axis of the body portion.

In accordance with one or more embodiments of the present invention, a shaft made from a separate piece of a round or a multi sided rod with an end having a machined thread that is adapted to screw into the thread in the rod channel of the body portion of the head unit, may be used as the driver or connection mechanism to a device (for example, a battery operated cordless and/or electric drill, other powered device, or a hand-powered device) that can turn (i.e., rotate) the head unit at sufficient speed to mix liquids, fluids and/or viscous products (hereinafter referred to collectively and/or singularly as "liquids"). Alternatively, the rod and head unit may have other configurations to enable them to be removably attached to each other, but be of sufficient strength to withstand the forces experienced when mixing liquids as well as when being entered or withdrawn from a container. For example, a ball and socket connection similar to socket and ratchet handle, a tapped and threaded hole passing from the outside of the body of the head to the inside of the body in which a set screw may be placed. A shaped rod channel, for example, a semi-circular rod channel, to receive similarly shaped semi-circular end of the rod. In addition, this configuration may use either or both of the ball and socket and set screw fastening mechanisms described previously. In accordance with one or more embodiments of the present invention, the threaded rod may be of any diameter, including, for example, ¼", ⅜", ½", etc., to allow a chuck from a drill, other powered device, or hand-powered device to be attached and drive the stirrer tool. The rod may also be of a variety of lengths that are sufficient to allow the head unit to reach the bottom of any container in which it will be used.

In accordance with one or more embodiments of the present invention, in addition to the fingers on the body of the head unit, one or more separate intermediate assemblies of the fingers may be slid on and be locked onto the rod by a variety of different methods and at adjustable levels. This may be necessitated by the material to be mixed and/or the size of the container to be mixed. In general, the intermediate assemblies may be used to provide additional stirring motion above the head unit and, as the head unit kicks up the sediment from the bottom of the container that has settled there, the intermediate assemblies add to the vortex action provided by the head unit.

In accordance with one or more embodiments of the present invention, and similar to the head unit, these intermediate assemblies may be made of plastic, composite and/or metal with springs or cable so that the flexibility of this part will still allow the assembly to pass through a smaller opening. Each intermediate assembly may have a coaxially aligned channel running through the body of the intermediate assembly and open through openings on opposite faces of the intermediate body portion that the rod may pass through and be fastened against. The coaxially aligned channel may be multi sided so as to match a multi-sided rod and provide the necessary fastening and/or locking component, for example, a set screw to keep the unit turning as the rest of the stirrer is turned in the liquid, or one or more circlips (i.e., circle clips)/"C"-clips and/or "E"-clips in one or more slots around the rod to lock the intermediate fingers at different heights along the rod.

In accordance with one or more embodiments of the present invention, an optional and separate retrieval cup may be made from plastic or another material may be provided as to aid in the removal of the stirrer from a container. The retrieval cup is adapted to minimize the spray and mess associated with removing the stirrer tool from the opening in the container after having mixed the product in the container. The retrieval cup may also aid in the easier handling of the stirrer, which may be covered in the stirred liquid. The cup may have a hole closely matching the diameter of the rod being used either with or without a grommet installed or molded into the cup to seal the rod to the cup and have sufficient size to accommodate the head unit to be drawn inside. In general, the cup may have a single opening in a bottom of the cup through which the rod may be passed prior to installation in a drill. Alternatively, the cup may be adapted to permit installation on the rod after the rod has been inserted and tightened into the drill by having a sealable slit through one side of the cup up to and into the opening in the bottom of the cup. In accordance with one or more embodiments of the present invention, the cup may be made from an inexpensive disposable material.

In accordance with one or more embodiments of the present invention, another type of enclosed mixing could be achieved by providing a cap that could fit over and seal a mixing cup or matched container. The cap would define a hole closely matching the diameter of the rod to allow the rod to pass through and seal the lid to the cup with the head unit inside. When the drill, other powered device, or hand-powered device, is turned on, the cap prevents the liquid inside the mixing cup or matched container from escaping the container. This permits mixing of the liquid in the mixing cup at high speeds because the cap prevents the liquid from splashing out of the container.

In accordance with one or more embodiments of the present invention, a kit may include, for example, stirrer head(s), rod(s), container(s) and matching container lid(s), intermediary element(s), etc.

In accordance with one or more embodiments of the present invention, the stirrer device is adapted to be able to enter a smaller diameter hole than its unfolded overall diameter (for example, the distance between the outer ends of opposing fingers that are perpendicular to the sides of the body portion) due to the natural capacity of each finger for flexible compression and fanning out again when it has cleared the container opening or spout. Once inside the container the stirrer may be activated in a direction that will keep the head screwed on in the same direction. This may be done using a drill or brace or any device that could be attached to the rod and driven in the proper direction.

In accordance with one or more embodiments of the present invention, the stirring action imparted to the material by the stirrer tool creates a vortex due to the friction of the fingers passing through the fluid and their alignment along the body of the head. This vortex causes the contents at the bottom of the container to be drawn to the top and back down again within the container in a continuous cycle. The fingers projecting from the top of the head unit can be pressed into the bottom and corners of the container to dig up any sediment or solids that are not picked up by the vortex action and then thrown into the fingers on the body portion and introduced into the mixing cycle as described above. The addition of intermediary fingers on the rod above the head unit further aids in the mixing cycle and assures a more homogenous mixture, especially in larger containers.

In accordance with one or more embodiments of the present invention, once adequate stirring of the product in the container is achieved the head unit of the stirrer tool may be removed by pulling it back through the opening of the container, if the head unit is to be retrieved. To retrieve the stirrer, the whole tool may be pulled back out through the opening or spout in the container by collapsing the fingers distally toward and almost parallel with the body portion inside the opening or spout as it exits the container. Any residual liquid that may splash out through the sudden flexing of the fingers back to their extended position after exiting the opening or spout may be arrested using a rag or an upside down splash cup that has a hole to allow the rod to pass through and catch the paint as it escapes the container. If the head unit is to be used only once, the drill or powered device may be reversed and, if the head and rod are threaded, the head will unscrew and remain in the container. If the head unit is left in the container, the fingers are configured so that the head unit will not hinder the flow of the mixed liquid as it exits the container.

In accordance with one or more embodiments of the present invention, if the head unit is retrieved, it may be cleaned up in a cup of an appropriate solvent and be reused or, if the head unit is not to be reused, it may simply be unscrewed from the rod and disposed of in accordance with the proper procedures for the liquid that was mixed. In general, the rod may be retained for future use with a new head unit. For a clean up of the head unit that reduces the splashing of cleanup, the head unit may be put in cup of thinner and sealed in the cup as described above for mixing other liquids.

In accordance with one or more embodiments of the present invention, the stirrer tool provides a variety of benefits. For example, the stirrer can provide an inexpensive way to mix viscous fluids within their container no matter what shape or unusual way the container is formed/configured. Also, the stirrer can replace expensive shaker paint mixers that can sell for thousands of dollars, as well as, being easily portable to job sites, something that cannot be said for shakers. In addition, most containers cannot be fitted into common paint shakers. A further benefit is the inventions ability to get into crevasses to assure that all sediment will be mixed in a uniform method, thus making true mixed colors or unmixed liquids uniform and consistent in texture. Likewise, the stirrer tool can make quicker work by homogeneous mixing of liquids to assure sprayed liquids and their thinners are uniform before application. Embodiments of the present invention may be made in specific sizes and lengths or oversized to allow for customizing by the consumer, i.e., by cutting the fingers to shorter lengths or using longer rods for larger containers, for example, 55 or larger gallon drums, containers, etc.

In accordance with one or more embodiments of the present invention, the stirrer tool may also be used in other industries, for example, the food industry, the medical field and the automotive field as well as the painting industry. Embodiments of the stirrer tool may be made inexpensively so that it may be cleaned up to be reused or just discarded. This may be particularly advantageous; if harmful or infectious materials are being mixed or stirred the head unit and rod may just be discarded. Similarly, if sterile materials are being mixed, the head unit and rod may be sterile and thrown away and/or re-sterilized for future use.

In accordance with one or more embodiments of the present invention, use of the stirrer tool can help provide longer shelf life for paint by not having to break the seal of a 5-Gallon paint can or other different sized and shaped containers, which tends to shorten the useful life of the material inside. Likewise, if the stirrer tool, and especially each finger, is made from plastic or a soft material, the stirrer tool may be used to stir liquids directly in the newer plastic containers on the market, since it is not as abrasive to the plastic shell of the container as other metal devices. In addition, the fingers may be easily clipped to shorter lengths to provide a stiffer stirrer for materials such as wood putty, plastic body filler (for example, Bondo® from the Bondo Corporation), resins such as fiberglass, wallboard compounds, and/or even cement and concrete. In general, the use of plastic in the construction of one of more embodiments of the present invention greatly reduces the risk of causing a spark with contact to metal containers thus making the mixing of flammable liquids a safer operation. The use of this invention dramatically increases the quality of sprayed paint mixtures, especially when reducing the paint with thinners, reducers and retarders and assures consistent paint coverage and atomization of paint at the sprayer tip and roller or brush tips.

FIG. 1 is a side perspective view of a stirrer tool showing an assembled unit including a stirrer head and rod, in accordance with an embodiment of the present invention. In FIG. 1, a stirrer tool 100 includes a rod 110 and a stirrer head 120. Rod 110 includes a distal end 102 and a proximal end 104 and may be made of metal, plastic, graphite, wood, as well as other like materials and may have a length ranging from approximately 5 inches to 36 inches or more. Rod 110 may have a diameter ranging from approximately ¼ inch to ⅝ inch or more and proximal end 104 may be smaller and/or larger than distal end 102. Rod 110 may, for example, have a cylindrical, hexagonal, and/or square cross-section. In general, proximal end 104 may be sized to fit into one or more standard sized drill chucks, for example, but not limited to, ¼ inch, ⅜ inch, ½ inch, ⅝ inch and/or equivalent metric sizes. Distal end 102 may include a fastening portion to enable a removable connection with stirrer head 120, and the fastening portion may include a threaded section, a ball-bearing (similar to that used for standard socket wrenches), a recess to receive a ball-bearing and/or a lock screw; a longitudinally flattened and/or recessed section against which and/or into which the lock screw may be biased; and one or more grooves to engage with elements, for example, but not limited to, ridges on an inner wall of a channel (see, for example, but not limited to, element 212 in FIG. 2) in the stirrer tool 120.

In FIG. 1, stirrer head 120 may include a body portion 122 having a longitudinal axis, a first plurality of projections 124. For example, in the embodiment of FIG. 1, first plurality of projections 124 includes three levels of substantially opposite projections that are, generally, evenly spaced around body portion 122 and extend substantially radially outward from an outer surface of body portion 122 and substantially perpendicular to the longitudinal axis of body portion 122. Body portion 122 may also include a second plurality of projections 126 extending in a substantially distal direction away from a distal end 127 of body portion 122, where the projections may be made of, for example, but not limited to, a substantially stiff monofilament and/or an injection molded plastic and/or plastic compound/composite, that is also flexible enough to be bent to fit through an opening in a container that is smaller in diameter than a diameter of stirrer head 120 as defined by outer ends of first plurality of projections 124 and stiff enough to mix viscous products. Each of the plurality of projections 124 and each of second plurality of projections 126 may have lengths ranging from ½ inch to 3 inches or longer, depending on the size of the container and viscosity of the liquid in the container to be mixed. The projections may be tailored, for example, shortened by cutting off a selected length of the monofilament, and first plurality of projections 124 may be configured to provide a vortex mixing action and second plurality of projections 126 may be configured to reach and stir up sediment on bottoms and in corners in containers. Because different containers may have different sizes and openings, the ultimate diameter of head unit 120 may be variable, for example, for a standard one-gallon paint can and/or for use through a spout in a five-gallon or larger can a head unit 120 with projections of approximately 3 inches may be used to fit through the openings and leave room between the outside ends of the projections and an inner wall of the can. Likewise, for an open-top five-gallon or larger can the projections may be sized to fit through the open tops of the cans and leave room between the outside ends of the projections and an inner wall of the can. For example, if a can has an inner side wall diameter of 10 inches, the diameter of the head unit when measured from the tips of opposite projections would be less than 10 inches, for example, but not limited to, 8 inches, to permit the free rotation of the head unit within the liquid in the can to produce the vortex mixing action. Additional considerations to take into account when sizing the projections, may include the viscosity of the liquid to be mixed and the power of the device used to rotate the stirrer tool within the liquid. Distal end 102 of rod 110 may be attached to a proximal end 128 of body portion 122, for example, by screwing distal end 102 into proximal end 128.

Figure 2:
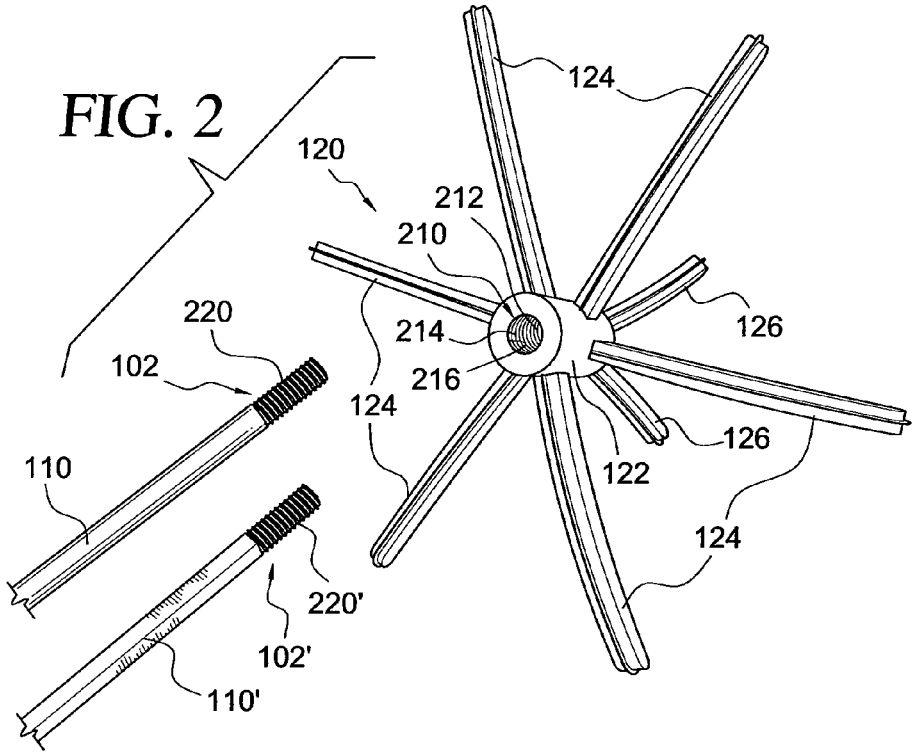
FIG. 2 is a close-up top perspective view of the stirrer tool of FIG. 1 showing the stirrer head detached from the rod and their male and female threaded portions, respectively, as well as an alternate embodiment of the rod, in accordance with an embodiment of the present invention.

FIG. 2 is a close-up top perspective view of the stirrer tool of FIG. 1 showing the stirrer head detached from the rod and their male and female threaded portions, respectively, as well as an alternate embodiment of the rod, in accordance with an embodiment of the present invention. In FIG. 2, proximal end 128 of stirrer tool 120 is shown to define an opening 210 into a channel 212 with female threads 214 disposed on an inner wall 216 of channel 212. Threads 214 are configured to receive and engage a male threaded section 220 of rod 110. Alternative embodiments are contemplated to include channel 212 without threads when the material used to manufacture stirrer tool 120 is softer than the material used to manufacture rod 110. In this embodiment, when male threaded section 220 of rod 100 are "screwed" into channel 212, female threads 214 are cut into inner wall 216 of channel 212. Other embodiments of channel 212 are also contemplated without threads, but with non-circular shapes, for example, but not limited to, circular, hexagonal, pentagonal, semi-circular, square, triangular, etc. See, for example, the hexagonal design and set screw fastening mechanism in FIGS. 27 and 28 and described herein may be used to fasten stirrer tool 120 securely on rod 110. Although not shown, another fastening mechanism is also contemplated in which any of the above shapes of channel 212 may have at least one ridge section on one or more sides of inner wall 216 and that protrudes into channel 212 in such a position so as to cooperate with one or more reciprocally shaped grooves in the distal end of rod 110 and operate to "snap" into and hold stirrer tool 120 securely on rod 110. Stirrer tool 120 can be "unsnapped" from rod 110 by pulling stirrer tool 120 off rod 110.

Figure 3:
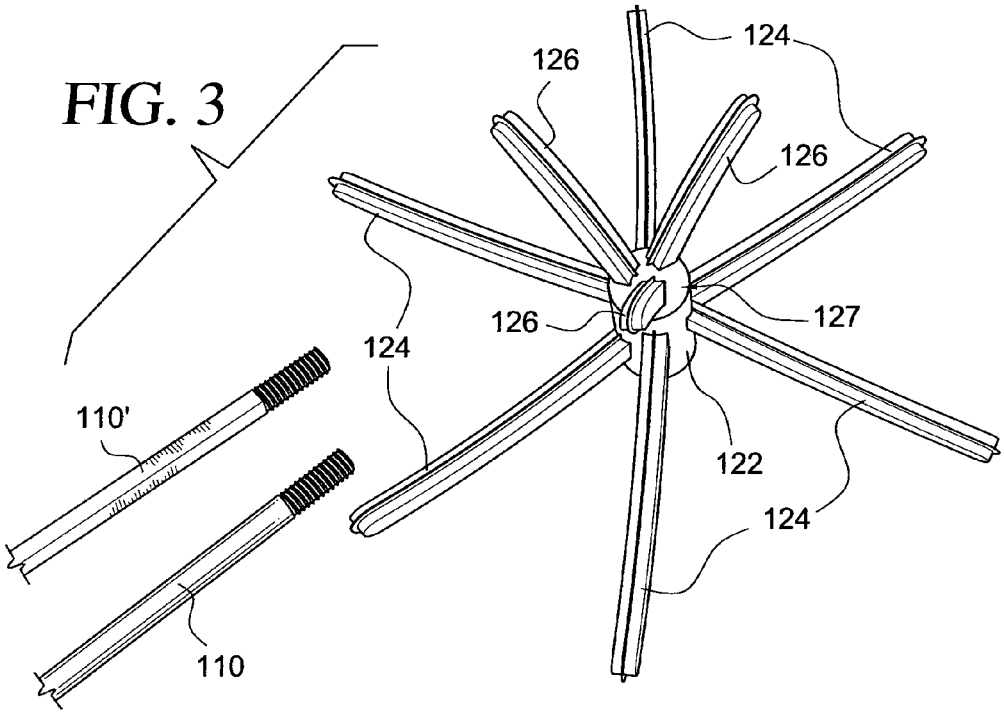
FIG. 3 is a bottom perspective view of the stirrer head of the stirrer tool of FIG. 1 showing the configuration and orientation of multiple fingers extending from a body portion of the stirrer head, in accordance with an embodiment of the present invention.

FIG. 3 is a bottom perspective view of the stirrer head of the stirrer tool of FIG. 1 showing the configuration and orientation of multiple fingers extending from a body portion of the stirrer head, in accordance with an embodiment of the present invention. In FIG. 3, second plurality of projections 126 are shown projecting from distal end 127 of body portion 122 at a slight angle away from parallel with the longitudinal axis of body portion 122. In use, second plurality of projections 126 may be used to stir-up sediment on the bottom of a container and/or dig the sediment out of corners in the container to ensure a complete mixing of the product in the container occurs.

Figure 4:
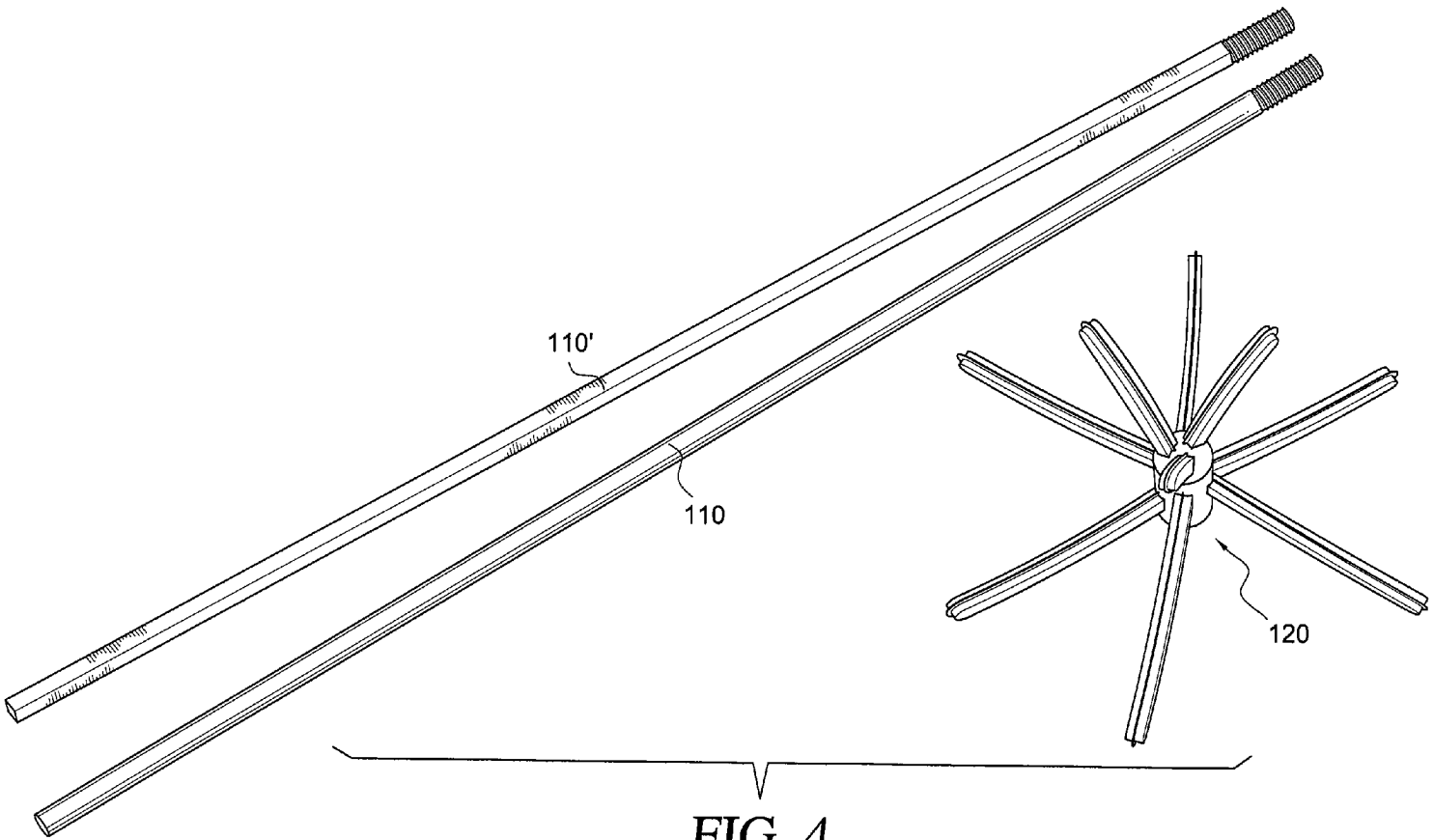
FIG. 4 is a side perspective view of the stirrer tool of FIGS. 1 and 2 showing the unit in an unassembled configuration, in accordance with an embodiment of the present invention.

FIG. 4 is a side perspective view of the stirrer tool of FIGS. 1 and 2 showing the unit in an unassembled configuration, in accordance with an embodiment of the present invention.

Figure 5:
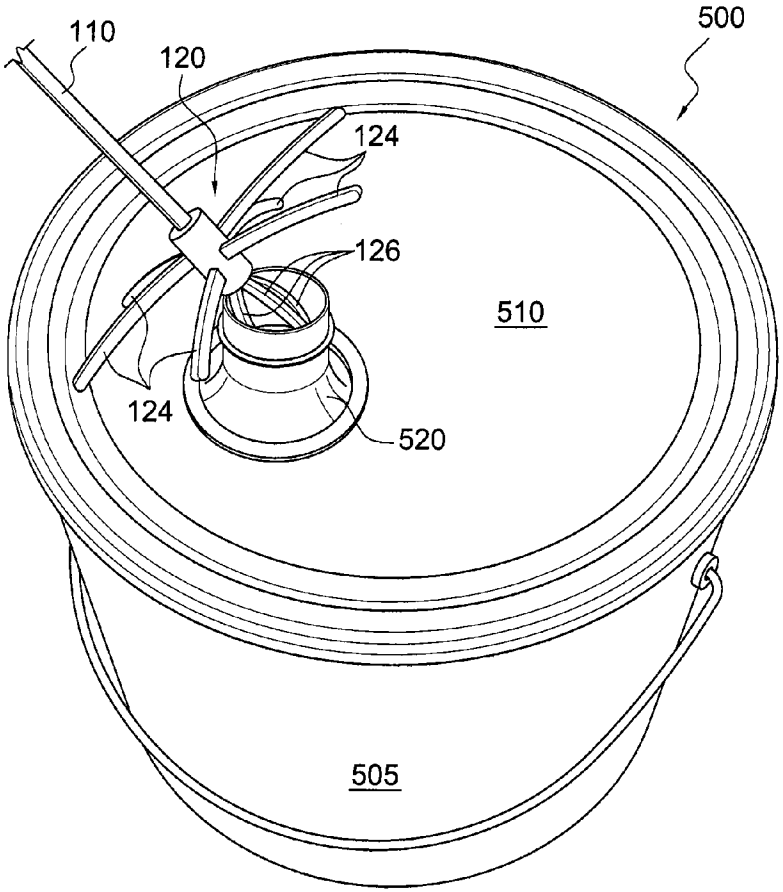
FIG. 5 is a top perspective view of a five-gallon paint can with a stirrer tool being lined up for insertion into the can through a pour spout in a top of the can, in accordance with an embodiment of the present invention.

FIG. 5 is a top perspective view of a five-gallon paint can with a stirrer tool being lined up for insertion into the can through a pour spout in a top of the can, in accordance with an embodiment of the present invention. In FIG. 5, a five-gallon paint can 500 may include a bottom container 505 to hold a liquid and a top 510 that is semi-permanently attached to bottom portion 505 and is designed to keep the liquid in bottom container 505. Top 510 may define an opening in which a spout 520 may be disposed for use in pouring. Spout 520 is shown in an extended position that could be used to pour the liquid from five-gallon paint can 500. Stirrer head 120 is shown partially inserted into spout 520 in top 510 in preparation for insertion through spout 520 and into five-gallon paint can 500.

Figure 6:
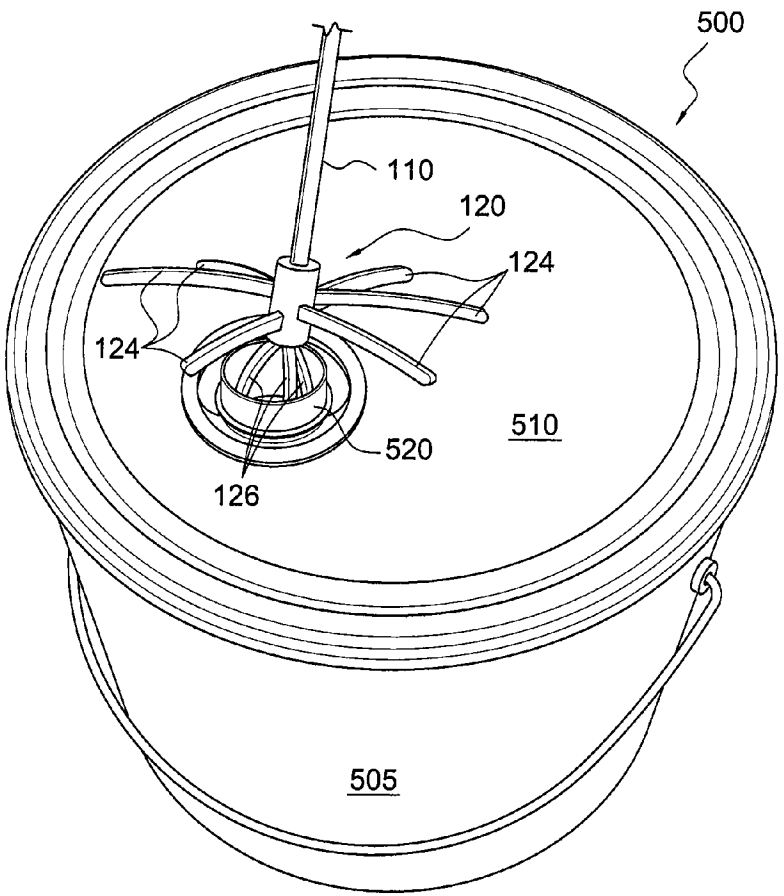
FIG. 6 is a top perspective view of the five-gallon paint can and the stirrer tool from FIG. 5 showing the stirrer tool just as it is beginning to be inserted into the can through the pour spout in a top of the can, in accordance with an embodiment of the present invention.

FIG. 6 is a top perspective view of the five-gallon paint can and the stirrer tool from FIG. 5 showing the stirrer tool just as it is beginning to be inserted into the can through the pour spout in a top of the can, in accordance with an embodiment of the present invention. In FIG. 6, second plurality of projections 126 of stirrer head 120 are shown partially inserted into spout 520, which is shown in a retracted position within top 510, and first plurality of projections 124 are shown above spout 520.

Figure 7:
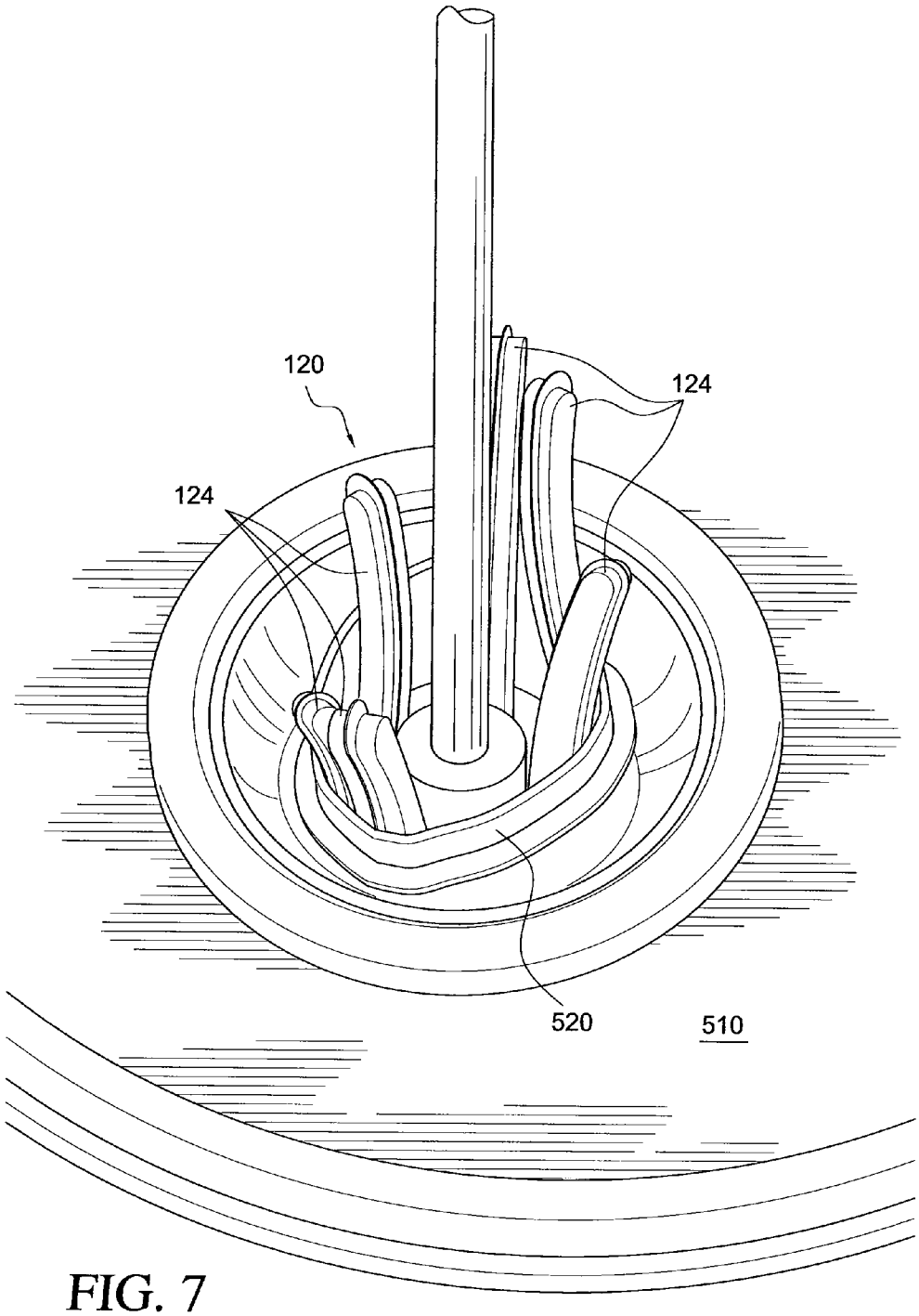
FIG. 7 is a top perspective view of the five-gallon paint can and the stirrer tool from FIG. 6 showing the fingers on the stirrer tool folding back against the body of the head of the stirrer tool as the stirrer tool is inserted into the can through the pour spout in a top of the can, in accordance with an embodiment of the present invention.

FIG. 7 is a top perspective view of the five-gallon paint can and the stirrer tool from FIG. 6 showing the fingers on the stirrer tool folding back against the body of the head of the stirrer tool as the stirrer tool is inserted into the can through the pour spout in a top of the can, in accordance with an embodiment of the present invention. In FIG. 7, first plurality of projections 124 are shown folded back toward a proximal end of rod 110 as they are being pushed through spout 520. As soon as stirrer head 120 is completely through spout 520, first plurality of projections 124 will return to their original position as shown in FIGS. 1 through 6.

Figure 8:
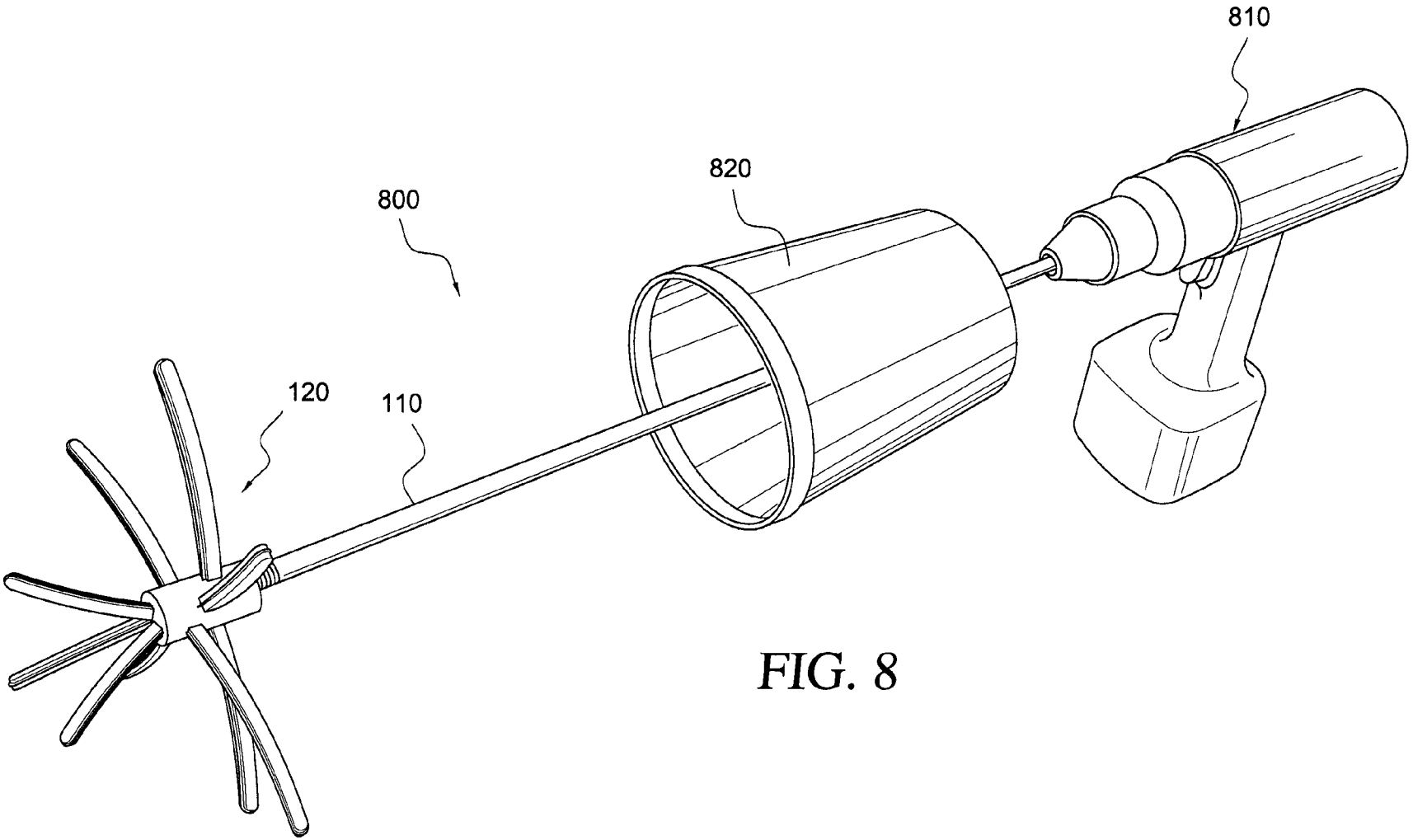
FIG. 8 is a side perspective view of a stirrer tool fastened into a cordless electric drill and with a retrieval/removal component being coaxially positioned on the rod, in accordance with an embodiment of the present invention.

FIG. 8 is a side perspective view of a stirrer tool fastened into a cordless electric drill and with a retrieval/removal component being coaxially positioned on the rod, in accordance with an embodiment of the present invention. In FIG. 8, a stirrer tool assembly 800 includes rod 110 connected to stirrer head 120 and a splash arrestor 820. Splash arrestor 820 may be a plastic cup or other container in which an opening having an inner diameter substantially the same as or slightly smaller than the outer diameter of rod 110 is located in substantially the center of a bottom of splash arrestor 820. Although the opening may have a larger diameter than rod 110, having a diameter that is substantially the same as or slightly smaller than the outer diameter of rod 110 permits splash arrestor to be held in position on rod 110 without slipping or moving up or down rod 110.

Figures 9, 10:
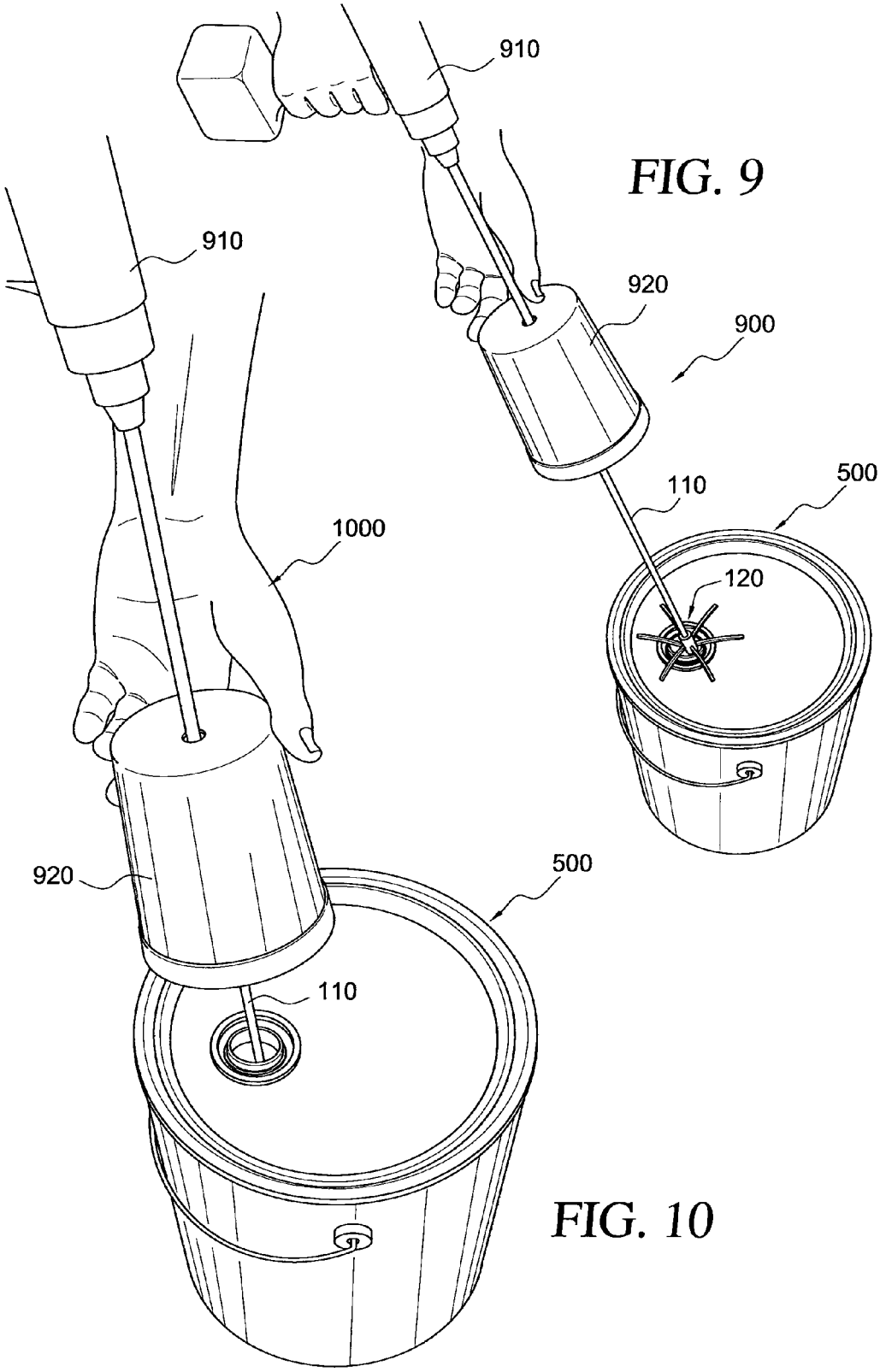
FIG. 9 is a top perspective view of a five-gallon paint can with a stirrer tool fastened into a cordless electric drill and with a retrieval/removal component being coaxially positioned on the rod and in position to be inserted into the five-gallon paint can, in accordance with an embodiment of the present invention.
FIG. 10 is a top perspective view of the five-gallon paint can and the stirrer tool of FIG. 9 with the stirrer tool inserted into the paint can and being used to mix/stir the paint in the paint can, in accordance with an embodiment of the present invention.

FIG. 9 is a top perspective view of a five-gallon paint can with a stirrer tool fastened into a cordless electric drill and with a retrieval/removal component being coaxially positioned on the rod and in position to be inserted into the five-gallon paint can, in accordance with an embodiment of the present invention. In FIG. 9, an alternative stirrer tool assembly 900 includes rod 110 connected to stirrer head 120 and a splash arrestor 920. In this embodiment, splash arrestor 920 may be made from, for example, a large paint mixing cup, which has an open top with a diameter large enough for stirrer head 120 to be pulled into and to hold first plurality of projections 124 against an inner wall of splash arrestor 920.

FIG. 10 is a top perspective view of the five-gallon paint can and the stirrer tool of FIG. 9 with the stirrer tool inserted into the paint can and being used to mix/stir the paint in the paint can, in accordance with an embodiment of the present invention. In FIG. 10, splash arrestor 920 from FIG. 9 is shown being held by an operator 1000 while drill 910 is used to mix the liquid in can 500 with the stirrer tool.

Figure 11:
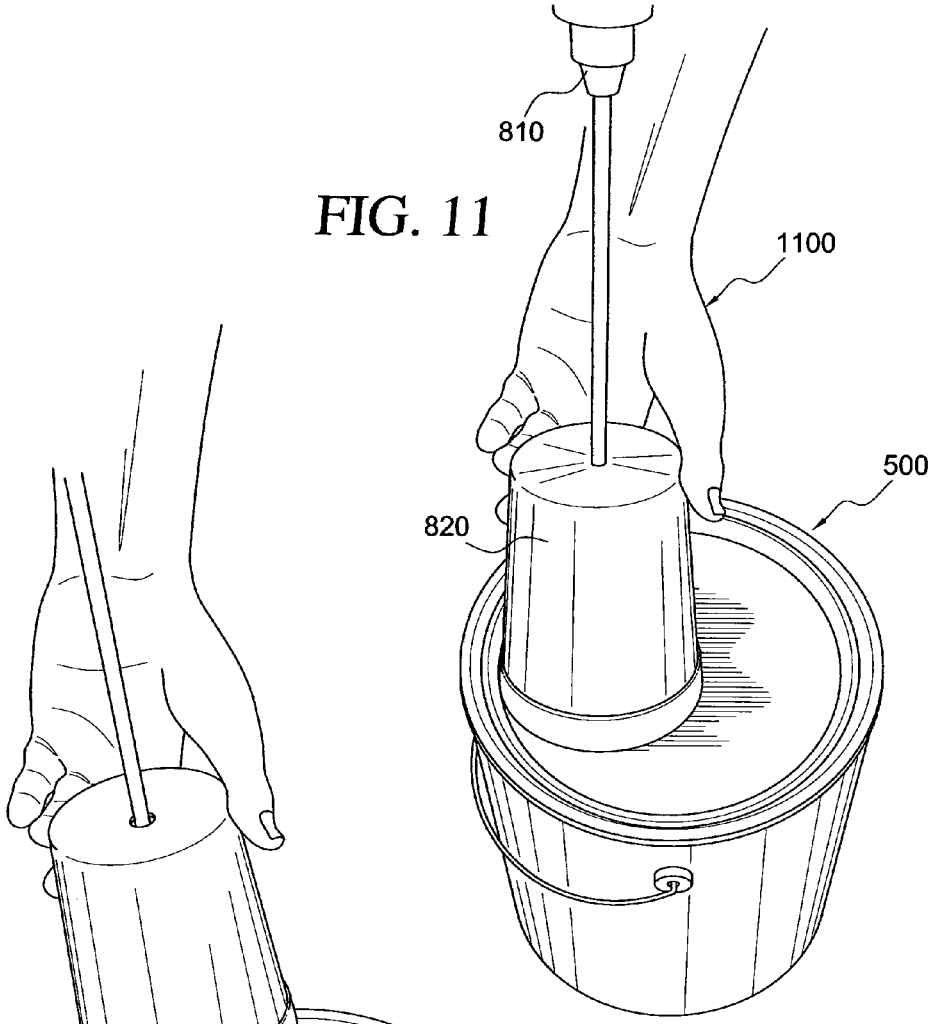
FIG. 11 is a top perspective view of a five-gallon paint can and a stirrer tool similar to that of FIG. 9 with the stirrer tool inserted into the paint can and being used to mix/stir the paint in the paint can, in accordance with an embodiment of the present invention.

FIG. 11 is a top perspective view of a five-gallon paint can and a stirrer tool similar to that of FIG. 9 with the stirrer tool inserted into the paint can and being used to mix/stir the paint in the paint can, in accordance with an embodiment of the present invention. In FIG. 11, splash arrestor 820 from FIG. 8 is shown being held by an operator 1100 while drill 810 is used to mix the liquid in can 500 with the stirrer tool.

Figure 12:
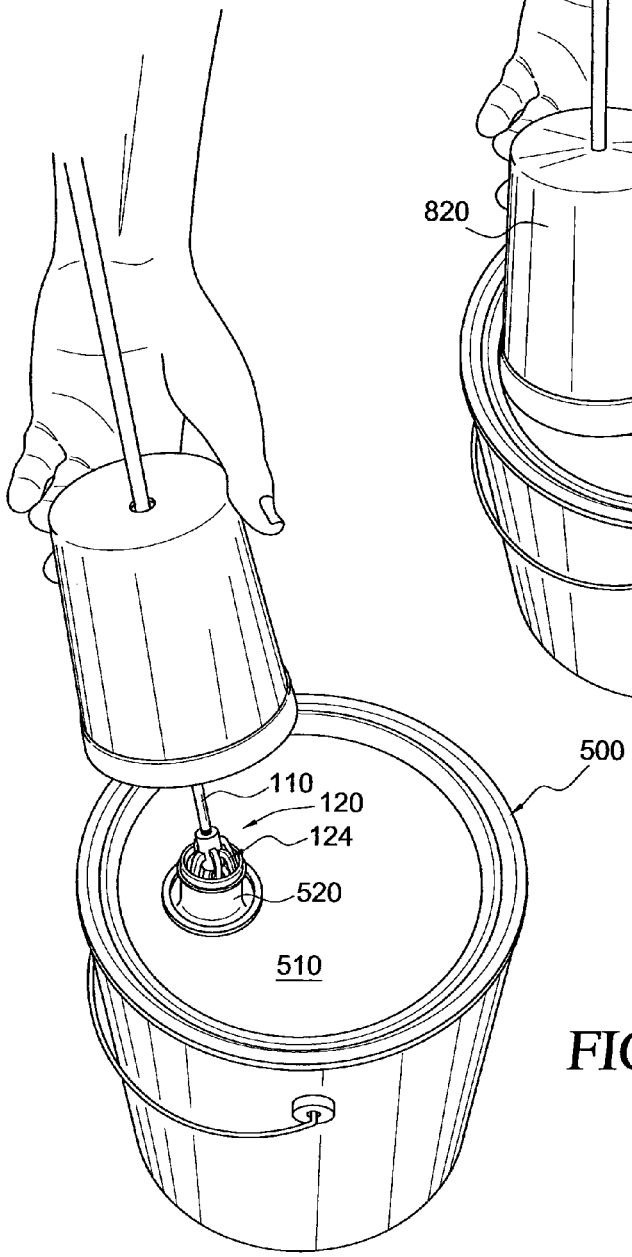
FIG. 12 is a top perspective view of the five-gallon paint can and stirrer tool of FIGS. 9 and 10 with the stirrer tool being removed from the paint can and showing the fingers on the head of the stirrer being folded against the body of the stirrer as the head is being withdrawn through the pouring spout of the five-gallon paint can, in accordance with an embodiment of the present invention.

FIG. 12 is a top perspective view of the five-gallon paint can and stirrer tool of FIGS. 9 and 10 with the stirrer tool being removed from the paint can and showing the fingers on the head of the stirrer being folded against the body of the stirrer as the head is being withdrawn through the pouring spout of the five-gallon paint can, in accordance with an embodiment of the present invention. In FIG. 12, stirrer head 120 is shown being removed from can 500 as it is being pulled back through spout 520, which is now in an outwardly extended position. First plurality of projections 124 may be seen emerging from and bent downwardly into can 500 by spout 520.

Figure 13:
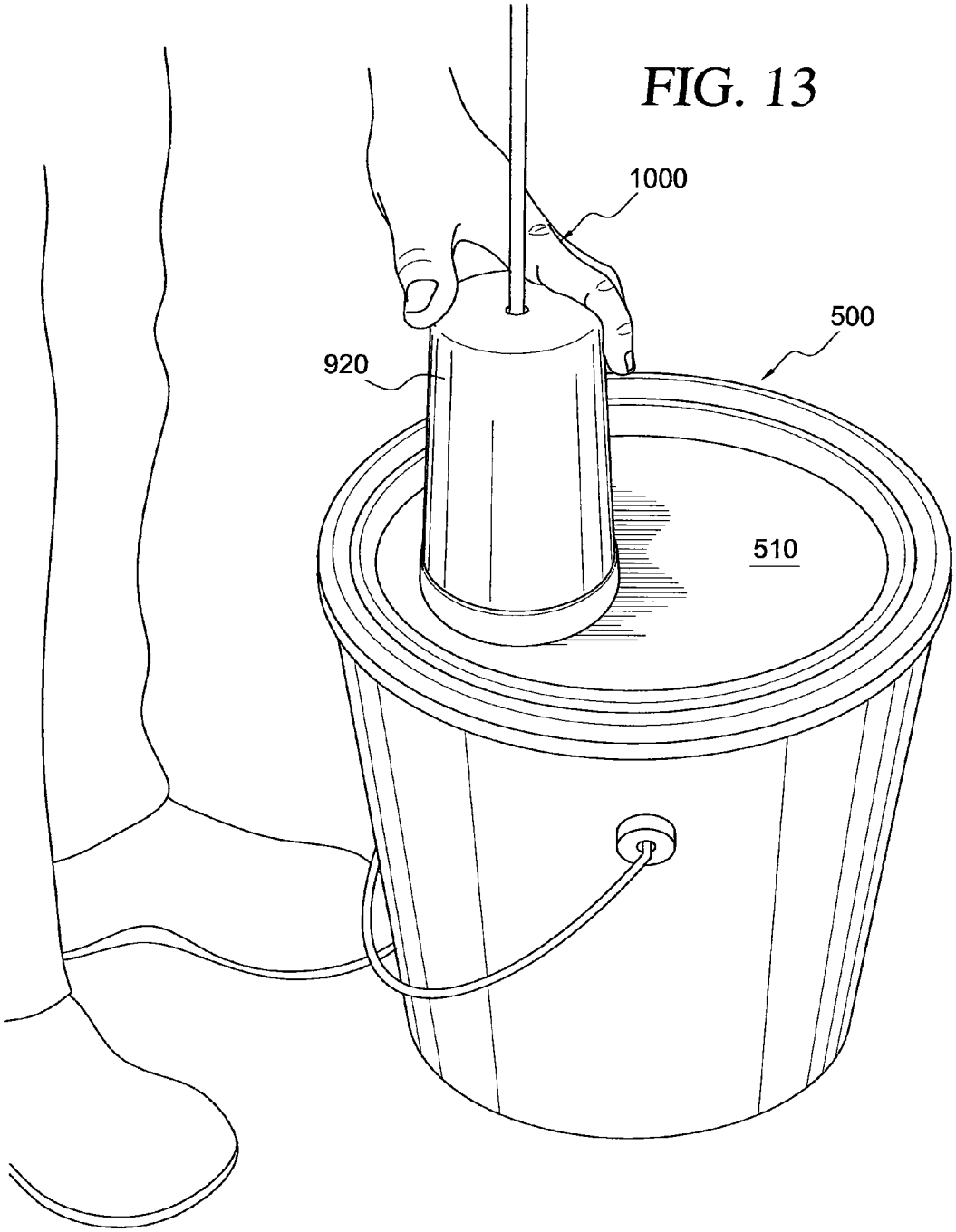
FIG. 13 is a top/side perspective view of the five-gallon paint can and stirrer tool of FIG. 12 with the retrieval/removal component being held against the top of the paint can and over the pouring spout in preparation of the removal of the stirrer tool from the five-gallon paint can, in accordance with an embodiment of the present invention.

FIG. 13 is a top/side perspective view of the five-gallon paint can and stirrer tool of FIG. 12 with the retrieval/removal component being held against the top of the paint can and over the pouring spout in preparation of the removal of the stirrer tool from the five-gallon paint can, in accordance with an embodiment of the present invention. In FIG. 13, splash arrestor 920 from FIG. 9 is shown being held by operator 1000 against top 510 of can 500 as stirrer head 120, which is hidden by splash arrestor 920 in FIG. 13. When stirrer head 120 is pulled through spout 520 and first plurality of projections 124 "spring" back into their normal extended position any liquid that may come off one or more of the first plurality of projections 124 will be contained by an inner wall of splash arrestor 920.

Figure 14:
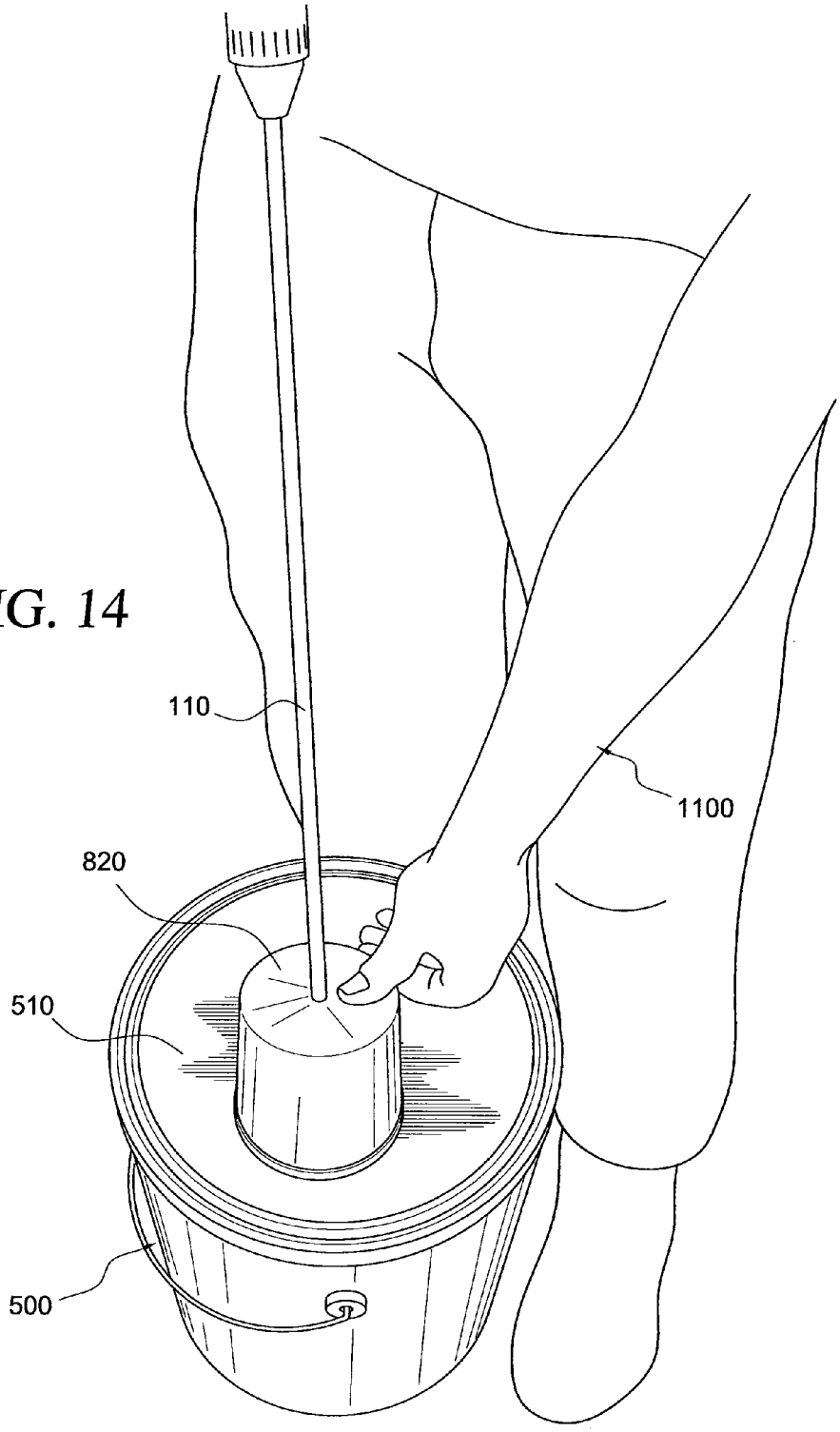
FIG. 14 is a top/side perspective view of the five-gallon paint can and stirrer tool of FIG. 11 with the retrieval/removal component being held against the top of the paint can and over the pouring spout in preparation of the removal of the stirrer tool from the five-gallon paint can, in accordance with an embodiment of the present invention.

FIG. 14 is a top/side perspective view of the five-gallon paint can and stirrer tool of FIG. 11 with the retrieval/removal component being held against the top of the paint can and over the pouring spout in preparation of the removal of the stirrer tool from the five-gallon paint can, in accordance with an embodiment of the present invention. In FIG. 14, splash arrestor 820 from FIG. 8 is shown being held by operator 1100 against top 510 of can 500 as stirrer head 120, which is hidden by splash arrestor 820 in FIG. 14. When stirrer head 120 is pulled through spout 520 and first plurality of projections 124 "spring" back into their normal extended position any liquid that may come off one or more of the first plurality of projections 124 will be contained by an inner wall of splash arrestor 820.

Figure 15:
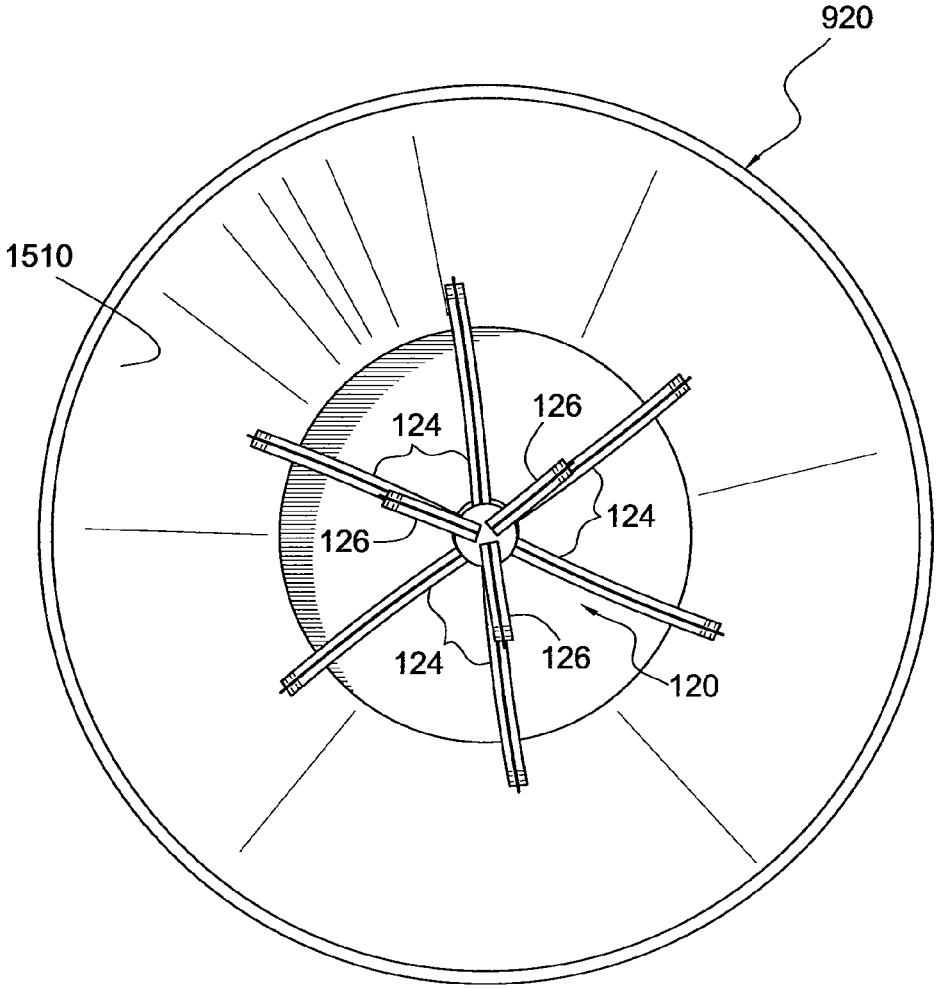
FIG. 15 is a top view of the retrieval/removal component and stirrer tool of FIG. 13 with the stirrer tool being surrounded by the retrieval/removal component such that the fingers of the stirrer tool are engaged against and held by an inner wall of the retrieval/removal component, in accordance with an embodiment of the present invention.

FIG. 15 is a top view of the retrieval/removal component and stirrer tool of FIG. 13 with the stirrer tool being surrounded by the retrieval/removal component such that the fingers of the stirrer tool are engaged against and held by an inner wall of the retrieval/removal component, in accordance with an embodiment of the present invention. In FIG. 15, stirrer head 120 is shown inside splash arrestor 920 so that first plurality of projections 124 are biased against an inner wall 1510 of splash arrestor 920. As a result, splash arrestor 920 prevents any liquid that may fly off first plurality of projections 124 and second plurality of projections 126 when they are pulled out of can 500 through the spout, which is covered by splash arrestor 920, in top 510.

Figure 16:
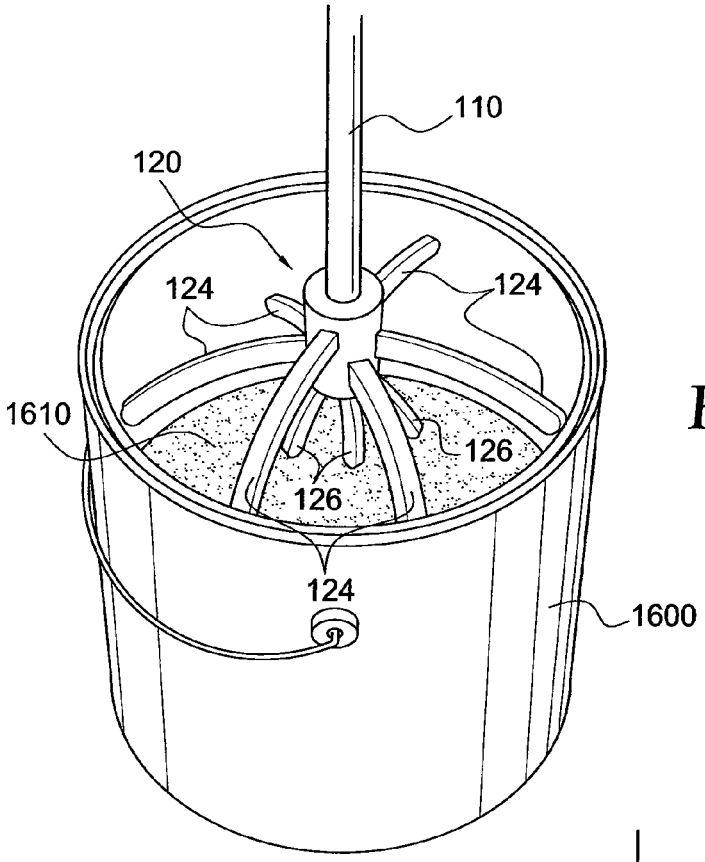
FIG. 16 is a top perspective view of a one-gallon paint can with a cleaning liquid with a stirrer tool being inserted into the can for cleaning, in accordance with an embodiment of the present invention.

FIG. 16 is a top perspective view of a one-gallon paint can with a cleaning liquid with a stirrer tool being inserted into the can for cleaning, in accordance with an embodiment of the present invention. In FIG. 16, a one-gallon paint can 1600 is shown containing a cleaning liquid 1610, for example, but not limited to, water, paint thinner, mineral spirits, and the like, in which stirrer head 120 may be immersed and cleaned by spinning stirrer head 120 and first plurality of projections 124 and second plurality of projections 126 in cleaning liquid 1610 as if it were a liquid being mixed by stirrer head 120. Alternatively, one-gallon paint can 1600 may contain a paint thinner 1610 on top of an amount of paint to be thinned (not shown) or may contain a liquid that has separated into its constituent parts and that needs to be remixed.

Figure 17:
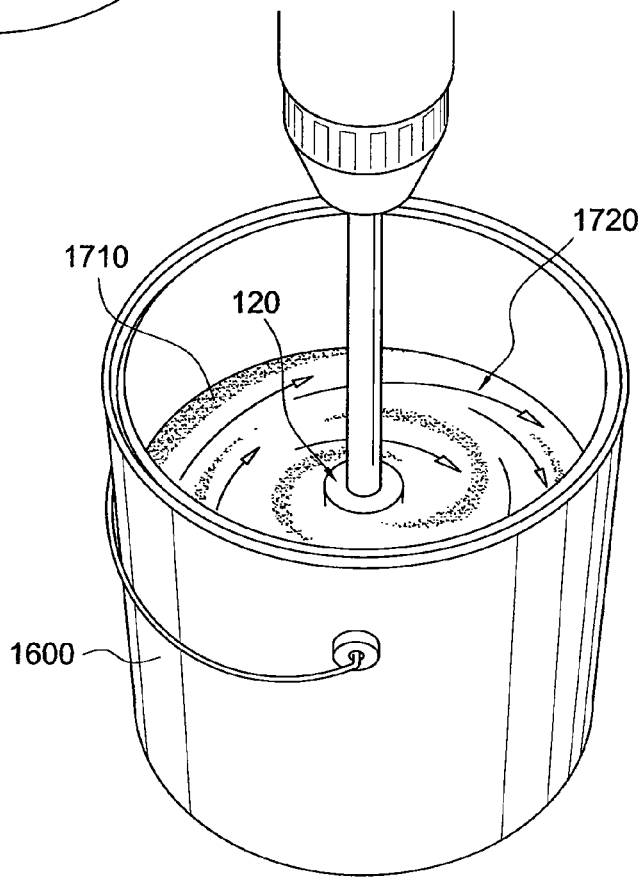
FIG. 17 is a top perspective view of the one-gallon paint can and stirrer tool of FIG. 16 showing the stirrer being cleaned in the cleaning liquid in the one-gallon paint can, in accordance with an embodiment of the present invention.

FIG. 17 is a top perspective view of the one-gallon paint can and stirrer tool of FIG. 16 showing the stirrer being cleaned in the cleaning liquid in the one-gallon paint can, in accordance with an embodiment of the present invention. In FIG. 17, stirrer head 120 is being spun through a liquid 1710 in can 1600 and has created a vortex flow within liquid 1710 as indicated by arrows 1720. The combination of vortex flow 1720 with the ability of stirrer head 120 to stir/dig up any solids that may have settled on the bottom of can 1600 helps to provide as complete a re-mixing of liquid 1710 as possible.

Figure 18:
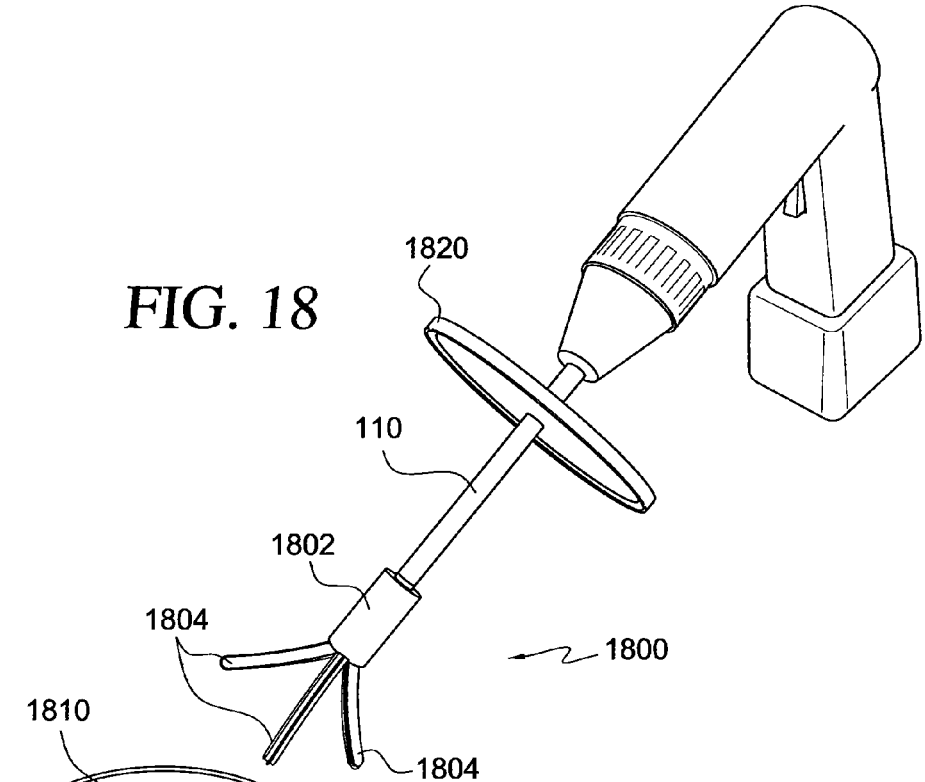
FIG. 18 is a top perspective view of the small container and another stirrer tool fastened into a cordless electric drill and with a stirring shield component adapted to fit onto a top of the small container and being coaxially positioned on the rod, in accordance with an embodiment of the present invention.

FIG. 18 is a top perspective view of the small container and another stirrer tool fastened into a cordless electric drill and with a stirring shield component adapted to fit onto a top of the small container and being coaxially positioned on the rod, in accordance with an embodiment of the present invention. In FIG. 18, an alternative stirrer tool 1800 is shown fastened to a distal end of rod 110 and to include a body portion 1802 to which multiple fingers 1804 are attached to and depend away from a distal end of body portion 1802. Rod 110 has a proximal end that is adapted to be removably fastened in a chuck of a drill. A cup 1805 is shown almost filled to the top with a liquid 1810, for example, but not limited to, paint, to be mixed. Rod 110 may also be seen to pass through approximately a center of a stirring shield 1820, for example, a cover, and be coaxially aligned thereto. Stirring shield 1820 may be adapted to attach to a top of cup 1805 and form a liquid-tight seal to prevent the leakage of liquid 1810 from cup 1805.

Figure 19:
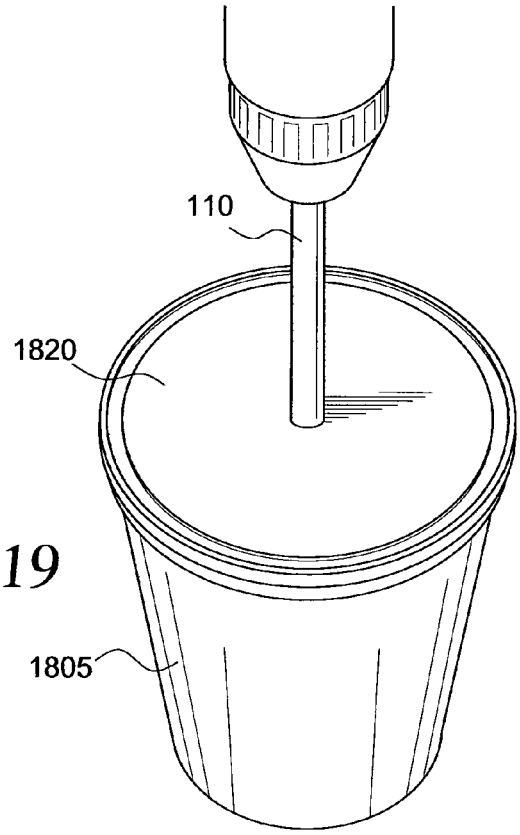
FIG. 19 is a top perspective view of the small container and the another stirrer tool of FIG. 18 fastened into a cordless electric drill inserted into and mixing the liquid in the small container and the stirring shield component engaged on the top of the small container, in accordance with an embodiment of the present invention.

FIG. 19 is a top perspective view of the small container and another stirrer tool of FIG. 18 fastened into a cordless electric drill inserted into and mixing the liquid in the small container and the stirring shield component engaged on the top of the small container, in accordance with an embodiment of the present invention. In FIG. 19, although stirrer tool 1800 is not visible, it is still fastened to the distal end of rod 110 and immersed in liquid 1810 within the sealed confines of cup 1805 and cover 1820.

Figure 20:
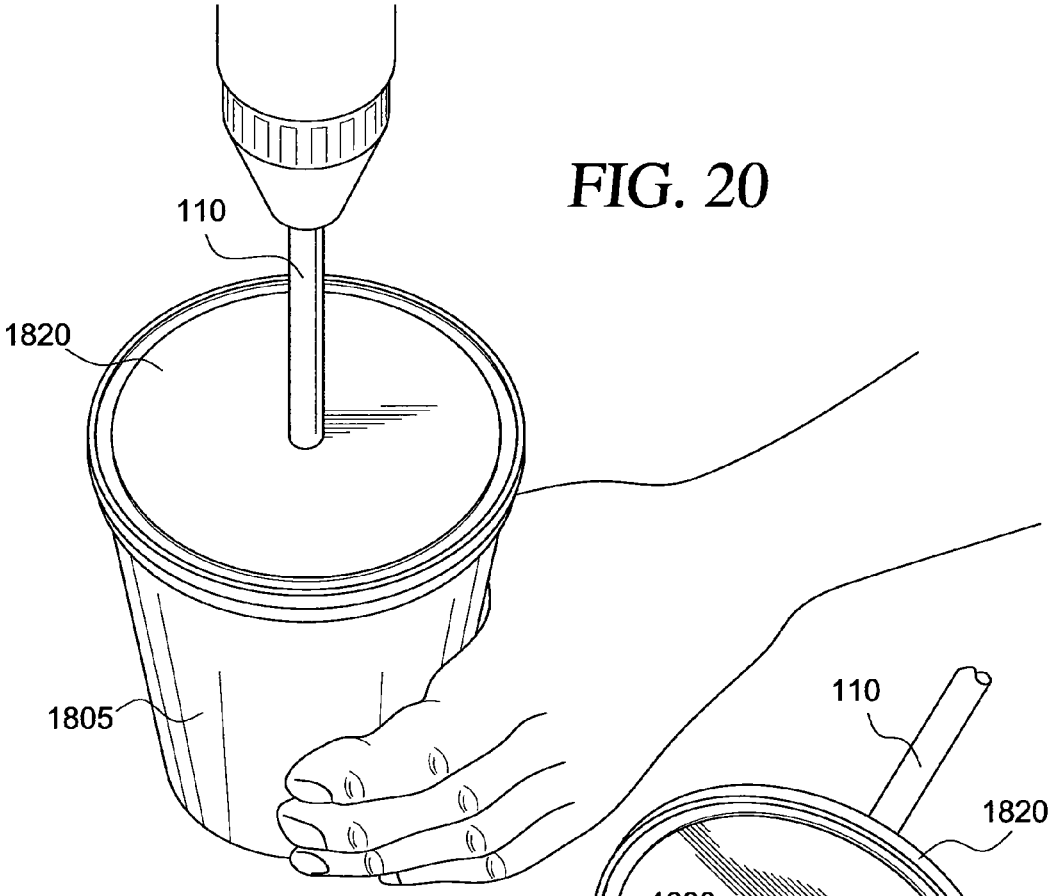
FIG. 20 is a top perspective view of the small container and the another stirrer tool of FIGS. 18 and 19 showing the small container being held during the mixing of the liquid in the small container, in accordance with an embodiment of the present invention.

FIG. 20 is a top perspective view of the small container and another stirrer tool of FIGS. 18 and 19 showing the small container being held during the mixing of the liquid in the small container, in accordance with an embodiment of the present invention. Similar to FIG. 19, in FIG. 20, although stirrer tool 1800 is not visible, it is still fastened to the distal end of rod 110 and immersed in and mixing liquid 1810 within the sealed confines of cover 1820 and cup 1805, which is being held by a user for stability.

Figure 21:
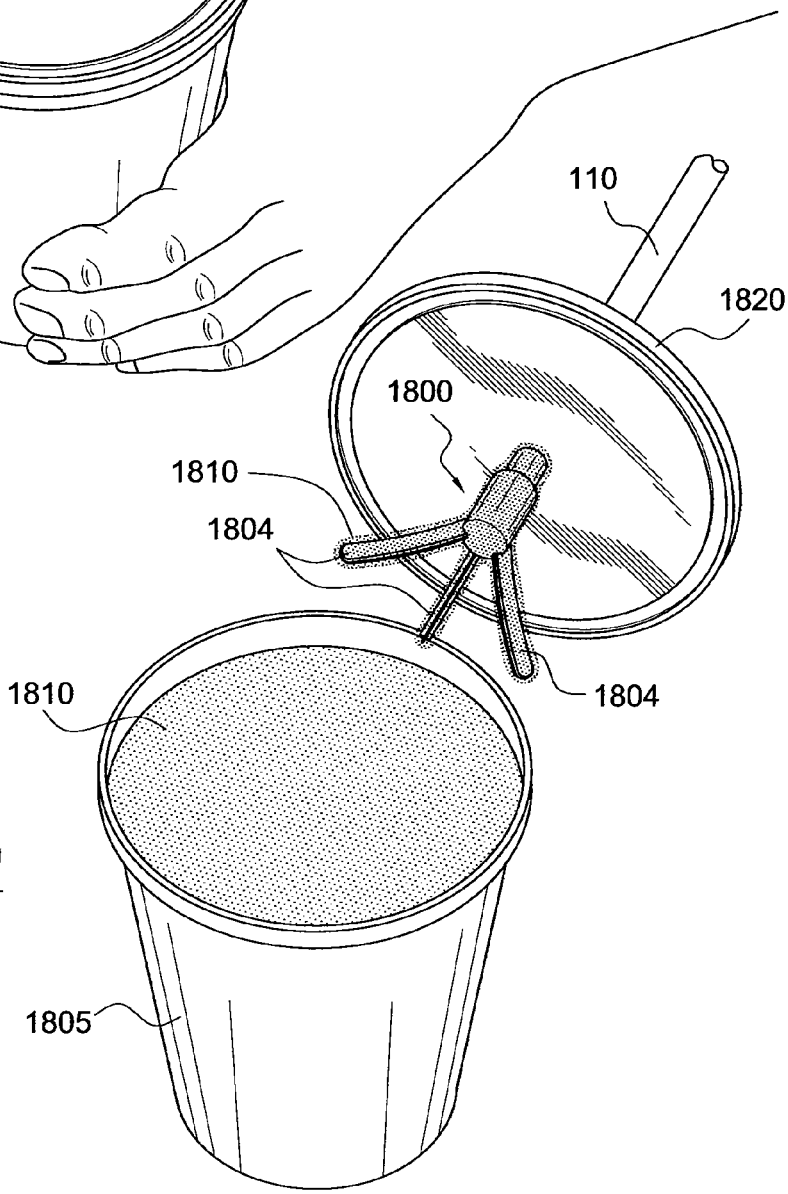
FIG. 21 is a top perspective view of the small container and the another stirrer tool of FIGS. 18-20 showing the stirrer tool and stirring shield being removed from the small container, in accordance with an embodiment of the present invention.

FIG. 21 is a top perspective view of the small container and another stirrer tool of FIGS. 18-20 showing the stirrer tool and stirring shield being removed from the small container, in accordance with an embodiment of the present invention. In FIG. 21, cover 1820 may be seen on rod 110 and stirrer tool 1800 and its multiple fingers 1804 may be seen covered in liquid 1810 and liquid 1810 in container 1805 may be seen to have a smooth and evenly mixed consistency.

Figure 22:
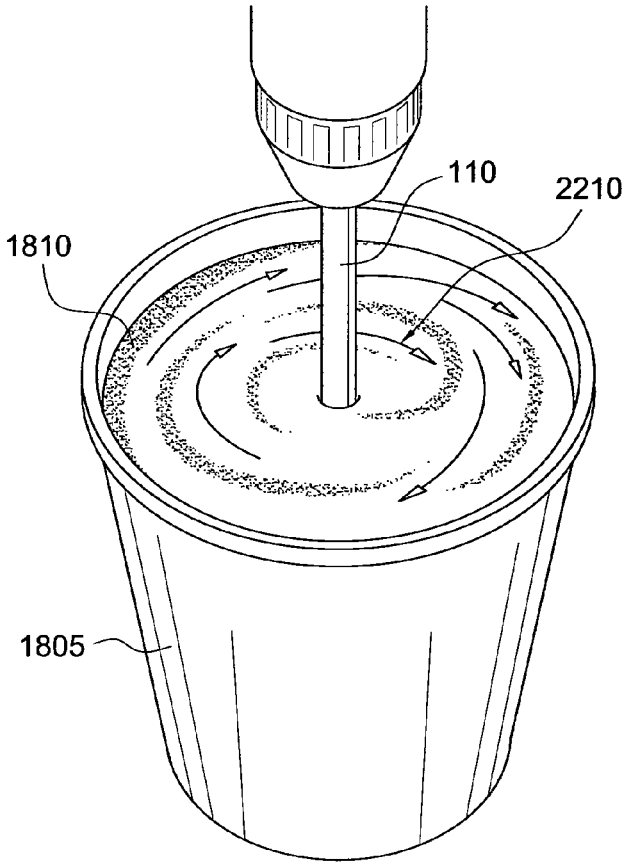
FIG. 22 is a top perspective view of the small container and the another stirrer tool of FIG. 18 fastened into a cordless electric drill showing the vortex mixing action imparted to the liquid by the operation of the stirrer tool in the small container, in accordance with an embodiment of the present invention.

FIG. 22 is a top perspective view of the small container and another stirrer tool of FIG. 18 fastened into a cordless electric drill showing the vortex mixing action imparted to the liquid by the operation of the stirrer tool in the small container, in accordance with an embodiment of the present invention. In FIG. 22, rod 110 may be seen disposed in liquid 1810, and specifically in a vortex 2210 within liquid 1810 that has been created by the spinning and mixing action of stirrer tool 1800.

Figure 23:
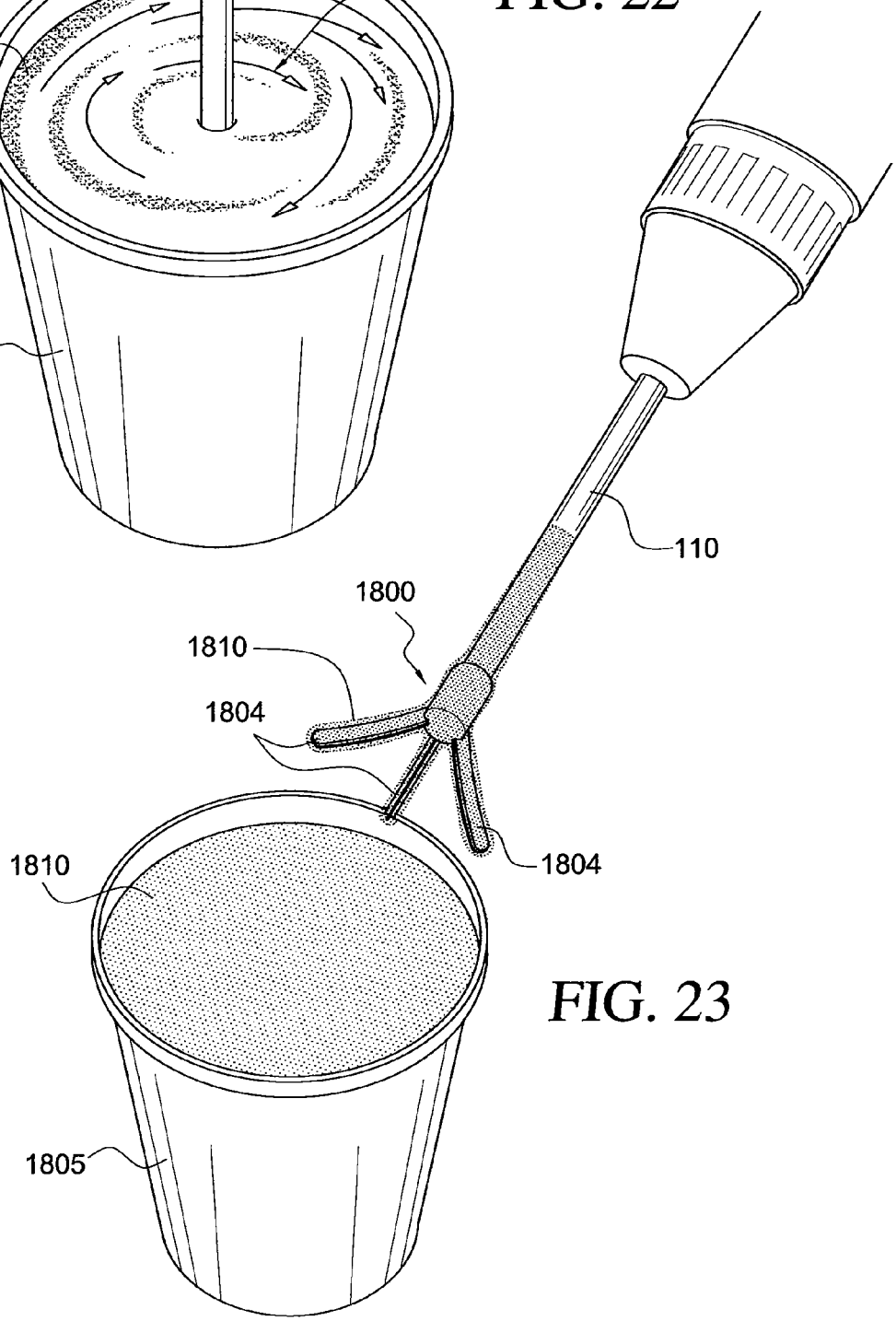
FIG. 23 is a top perspective view of the small container and the another stirrer tool of FIG. 22 fastened into a cordless electric drill being removed from the liquid in the small container, in accordance with an embodiment of the present invention.

FIG. 23 is a top perspective view of the small container and another stirrer tool of FIG. 22 fastened into a cordless electric drill being removed from the liquid in the small container, in accordance with an embodiment of the present invention. In FIG. 23, stirrer tool 1800 and multiple fingers 1804 are covered in liquid 1810, which has been thoroughly mixed in cup 1805 by the action of stirrer tool 1800.

Figure 24:
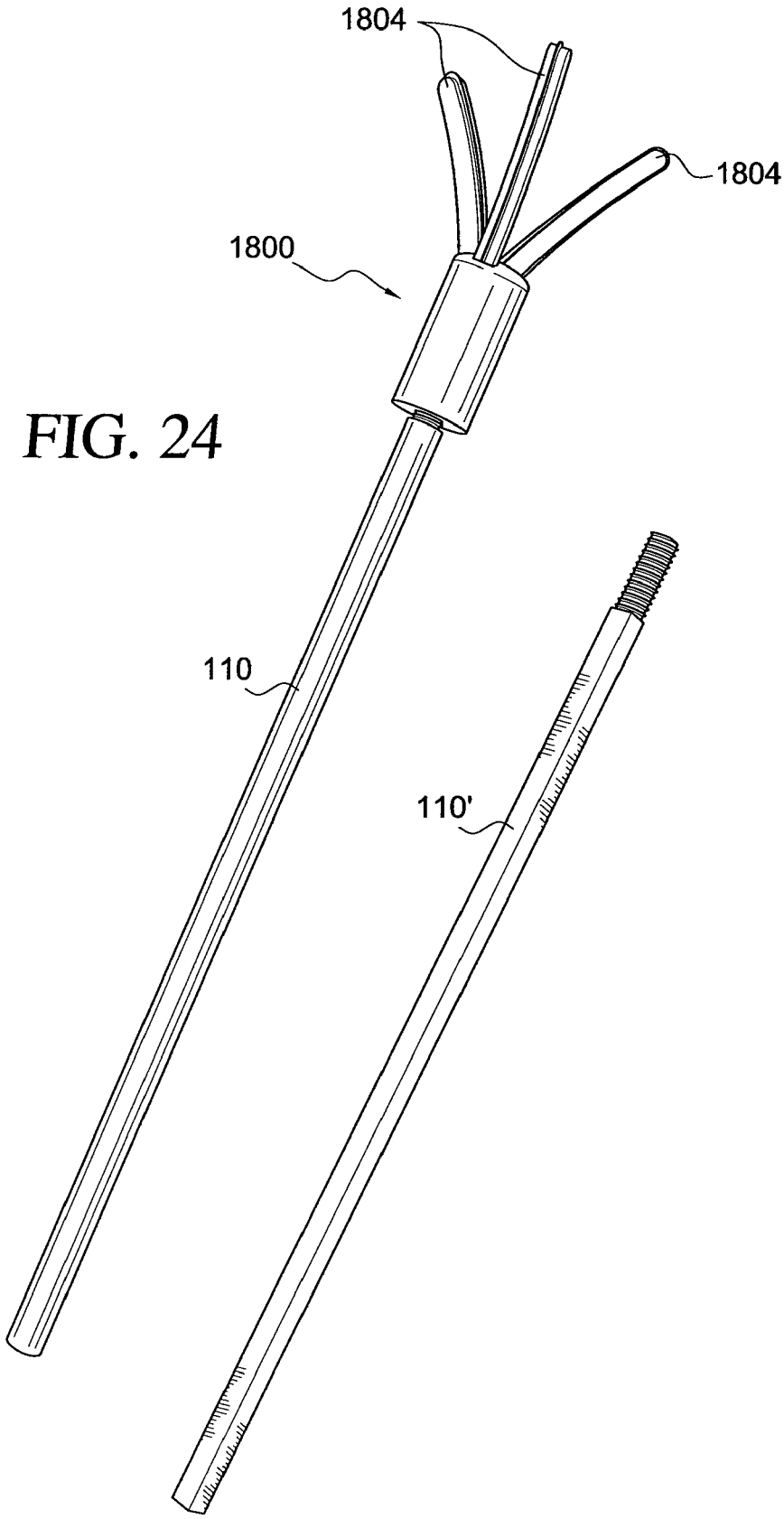
FIG. 24 is a side perspective view of the another stirrer tool of FIGS. 18-23 showing an assembled unit including a stirrer head and rod as well as an alternate rod, in accordance with an embodiment of the present invention.

FIG. 24 is a side perspective view of the another stirrer tool of FIGS. 18-23 showing an assembled unit including a stirrer head and rod as well as an alternate rod, in accordance with an embodiment of the present invention. In FIG. 24, stirrer tool 1800 with multiple fingers 1804 is shown connected to rod 110 and alternate rod 110' is shown separate from stirrer tool 1800.

Figure 25:
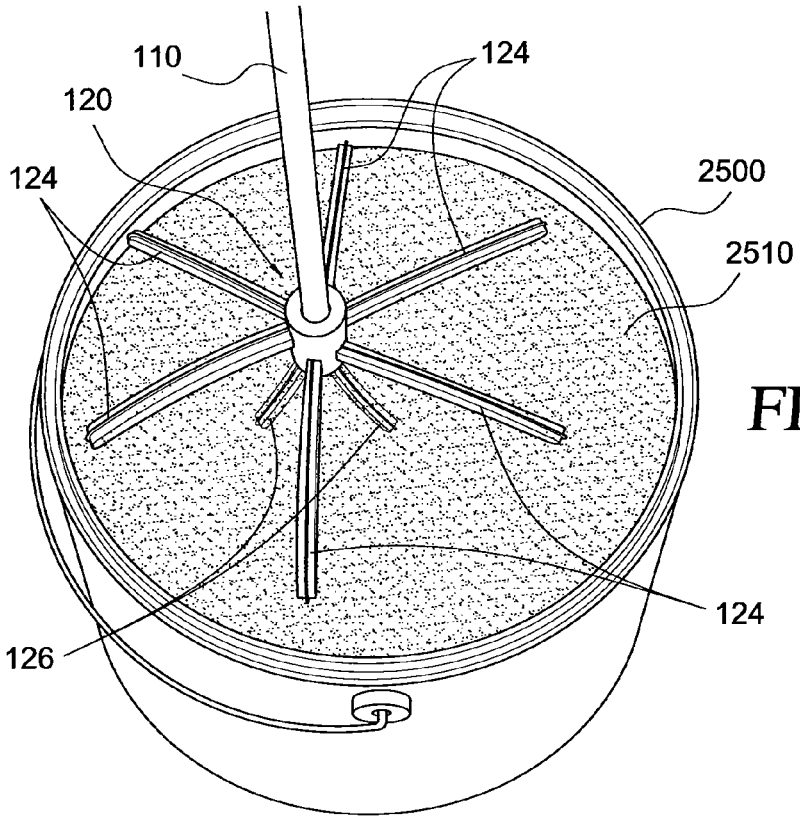
FIG. 25 is a top perspective view of a one-gallon paint can with a paint mixture with a stirrer tool being inserted into the can to mix the paint, in accordance with an embodiment of the present invention.

FIG. 25 is a top perspective view of a one-gallon paint can with a paint mixture with a stirrer tool being inserted into the can to mix the paint, in accordance with an embodiment of the present invention. In FIG. 25, a can 2500, which contains a liquid 2510, is shown with stirrer tool 120 being inserted into liquid 2510.

Figure 26:
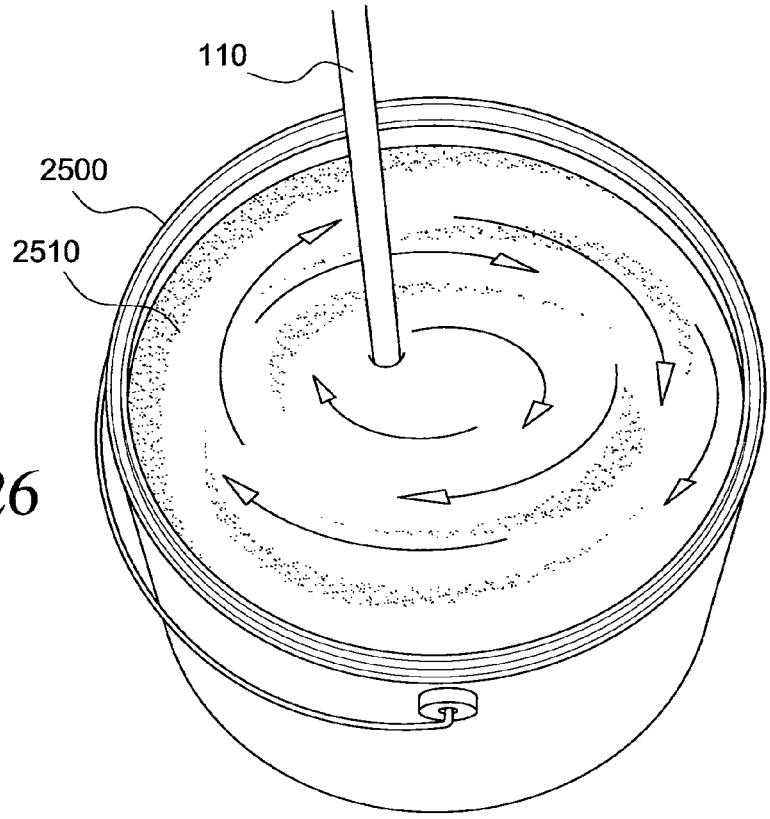
FIG. 26 is a top perspective view of the one-gallon paint can and stirrer tool of FIG. 25 showing the stirrer mixing the paint mixture in the one-gallon paint can and the vortex action imparted to the paint mixture during mixing, in accordance with an embodiment of the present invention.

FIG. 26 is a top perspective view of the one-gallon paint can and stirrer tool of FIG. 25 showing the stirrer mixing the paint mixture in the one-gallon paint can and the vortex action imparted to the paint mixture during mixing, in accordance with an embodiment of the present invention. In FIG. 26, stirrer tool 120 from FIG. 25 has been completely immersed in and is being operated to mix liquid 2510 in can 2500.

Figure 27:
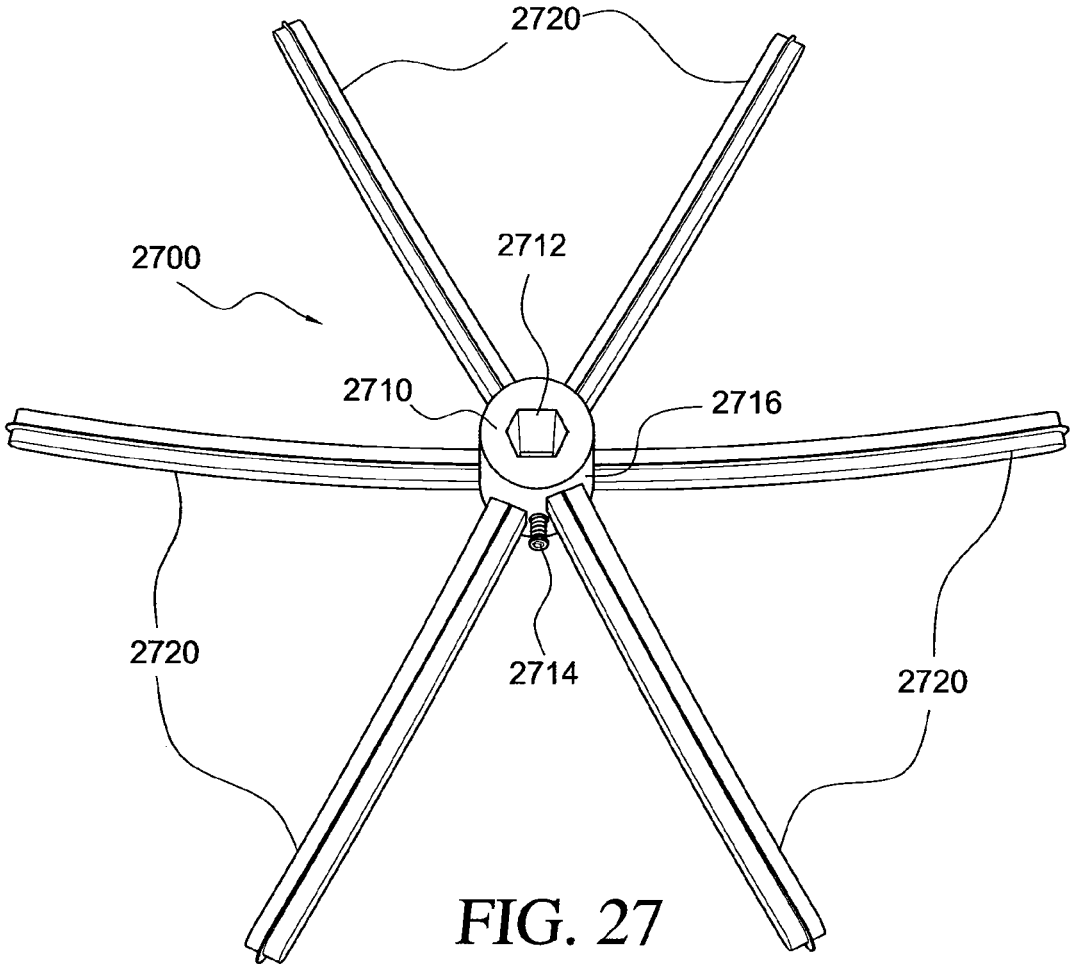
FIG. 27 is a top perspective view of an intermediary finger assembly for use with the stirrer units in FIGS. 1-26, in accordance with an embodiment of the present invention.

FIG. 27 is a side perspective view of an intermediary finger assembly for use with the stirrer units in FIGS. 1-26, in accordance with an embodiment of the present invention. In FIG. 27, an intermediary finger assembly 2700 is shown that includes a substantially cylindrical body 2710 that defines a coaxially aligned central channel 2712. Coaxially aligned central channel 2712 is shown to have a non-circular cross-sectional shapes, such as, for example, but not limited to, a triangular, a square, a semi-circular, an oval, a hexagonal, etc. cross-sectional shapes, which helps to prevent coaxially aligned central channel 2712 from rotating around a rod, for example, rod 110 of FIG. 1, to which it is affixed. Substantially cylindrical body 2710 may also have a threaded set screw channel substantially perpendicularly through substantially cylindrical body 2710 into central channel 2712 to receive a cooperatively threaded set screw 2714 and/or other fastening mechanism therein. Set screw 2714 may be adapted to be threaded through cylindrical body 2710 and into central channel 2712 to engage and lock intermediary finger assembly 2710 into place on rod 110. In another embodiment, body 2710 may be affixed to rod 110 to limit its longitudinal movement by using a circlip/"E"-clip/"C"-clip that would clip into a circumferential slot around rod 110. Coaxially aligned central channel 2712 may also have a circular cross-sectional shape. In general, multiple fingers 2720 may be connected to/extend from intermediary finger assembly 2710 at substantially perpendicular angles to and spaced around an outer surface 2716 of body 2710. However, unlike some embodiments of stirrer head 120, multiple fingers 2720 do not pass completely through intermediary finger assembly 2710 and central channel 2712. In fact, and regardless of how it is manufactured (e.g., injection molded, fingers glued into openings in a body, etc.), none of multiple fingers 2720 can extend into central channel 2712 of intermediary finger assembly 2710, because they would block the insertion of rod 110 therethrough.

Figure 28:
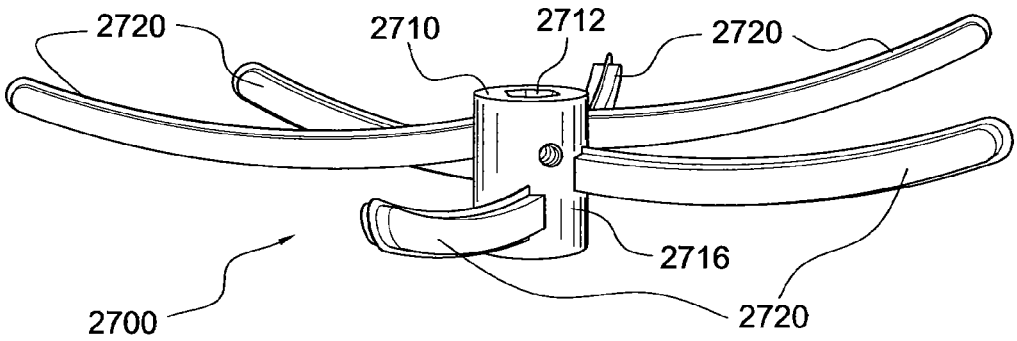
FIG. 28 is a side perspective view of the intermediary finger assembly of FIG. 27, in accordance with an embodiment of the present invention.

FIG. 28 is a side perspective view of the intermediary finger assembly of FIG. 27, in accordance with an embodiment of the present invention. In FIG. 28, intermediary finger assembly 2700 is shown with three pairs of opposing fingers such that each pair of opposing fingers is aligned in a separate plane from the other pairs of opposing fingers and where each pair of opposing fingers is substantially perpendicular to body 2710 of intermediary finger assembly 2700.

Figure 29:
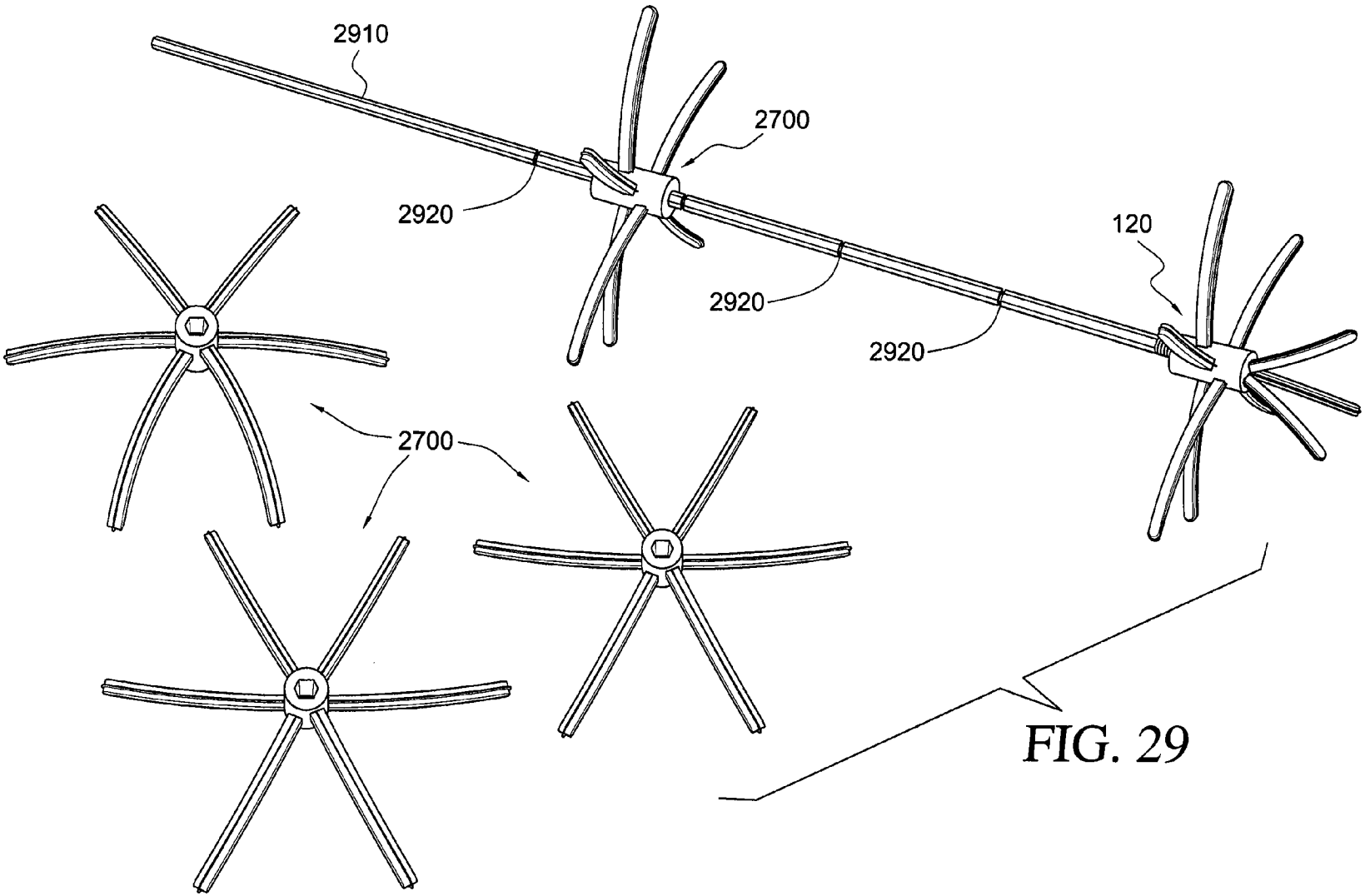
FIG. 29 is a side perspective view of a stirrer tool showing an assembled unit including the stirrer head, the intermediary finger assembly and the rod, in accordance with an embodiment of the present invention.

FIG. 29 is a side perspective view of a stirrer tool showing an assembled unit including the stirrer head, the intermediary finger assembly and the rod, in accordance with an embodiment of the present invention. In FIG. 29, a rod 2910 may include one or more circumferential grooves 2920 substantially evenly spaced along rod 2910. Although rod 2910 is shown as having a hexagonal shape, which is sized to fit within opening 2712 in intermediary finger assembly 2700, the other shapes described above in relation to opening 2712 in FIG. 27 are also possible. Each groove 2920 may be configured to receive a fastening means/mechanisms, for example, a circlip/"E"-clip/"C"-clip (see FIG. 30), "O"-Ring, or the like. In general, this may be achieved by removing sufficient material from rod 2910 and leaving a substantially cylindrically shaped-core over which the fastening means/mechanisms may be affixed. Placing fastening means/mechanisms in adjacent grooves on either side of intermediary finger assembly 2700 prevents intermediary finger assembly 2700 from moving past the fastening means/mechanisms. Alternative embodiments are also contemplated in which holes may be drilled perpendicularly through rod 2910 and fastening means, for example, but not limited to, cotter pins, spring pins, dowel pins, spring clips, quick-release pins, star fasteners, or detent pins may be inserted through the holes to hold the intermediary finger assembly 2700 in a selected position.

Figure 30:
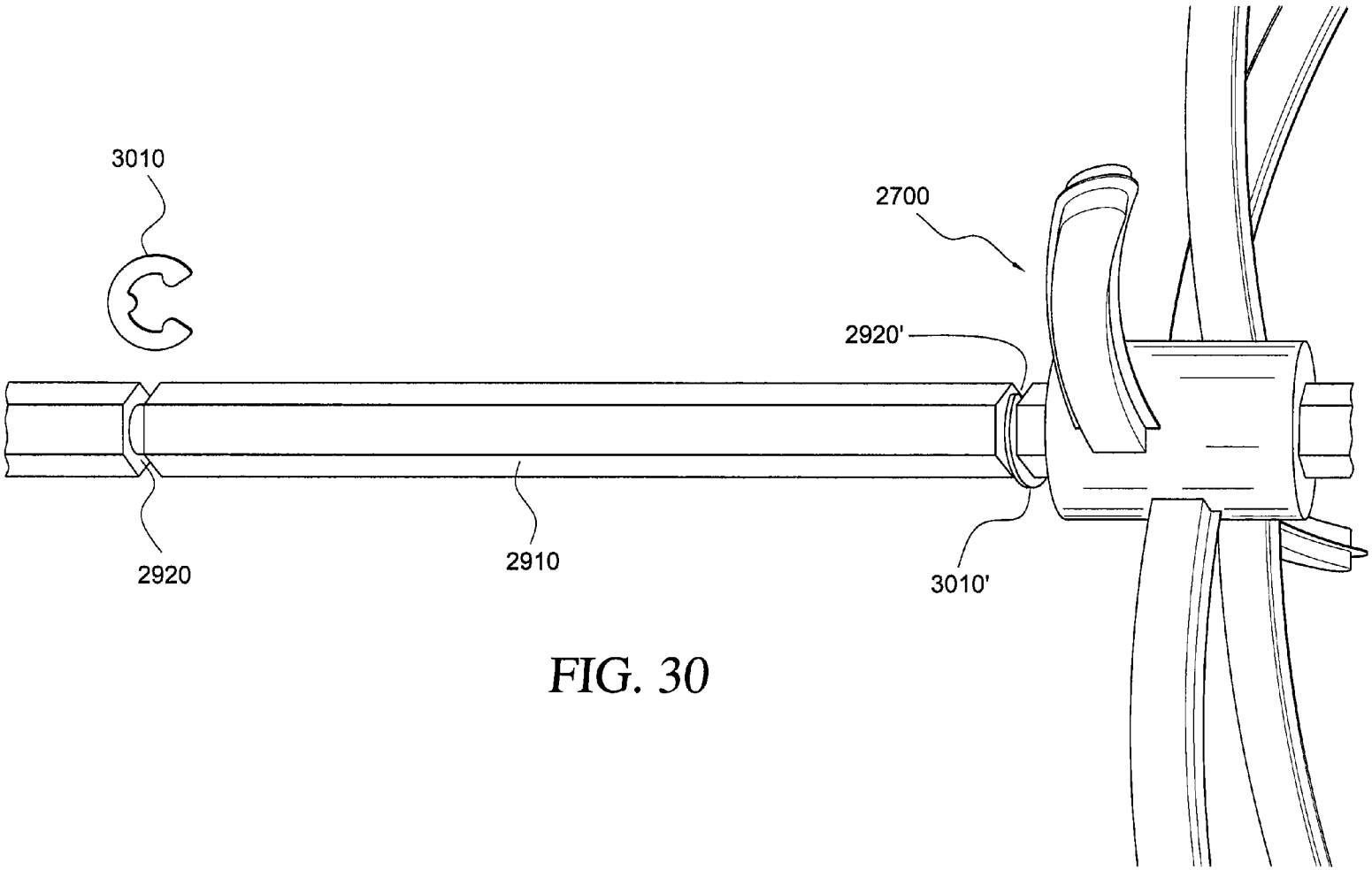
FIG. 30 is a close-up side perspective view of the stirrer tool of FIG. 29 showing the rod, circumferential grooves around the rod, a fastening mechanism for use in the grooves, and the intermediary finger assembly on the rod, in accordance with an embodiment of the present invention.

FIG. 30 is a close-up side perspective view of the stirrer tool of FIG. 29 showing the rod, circumferential grooves around the rod, a fastening mechanism for use in the grooves, and the intermediary finger assembly on the rod, in accordance with an embodiment of the present invention. In FIG. 30, a first circlip/"E"-clip/"C"-clip 3010 is shown apart from and above a first groove 2920 while a second circlip/"E"-clip/"C"-clip 3010' is shown inserted into a second groove 2920' next to an end of intermediary finger assembly 2700. In this position, second circlip/"E"-clip/"C"-clip 3010' will prevent intermediary finger assembly 2700 from moving past second groove 2920' toward first groove 2920.

Figure 31:
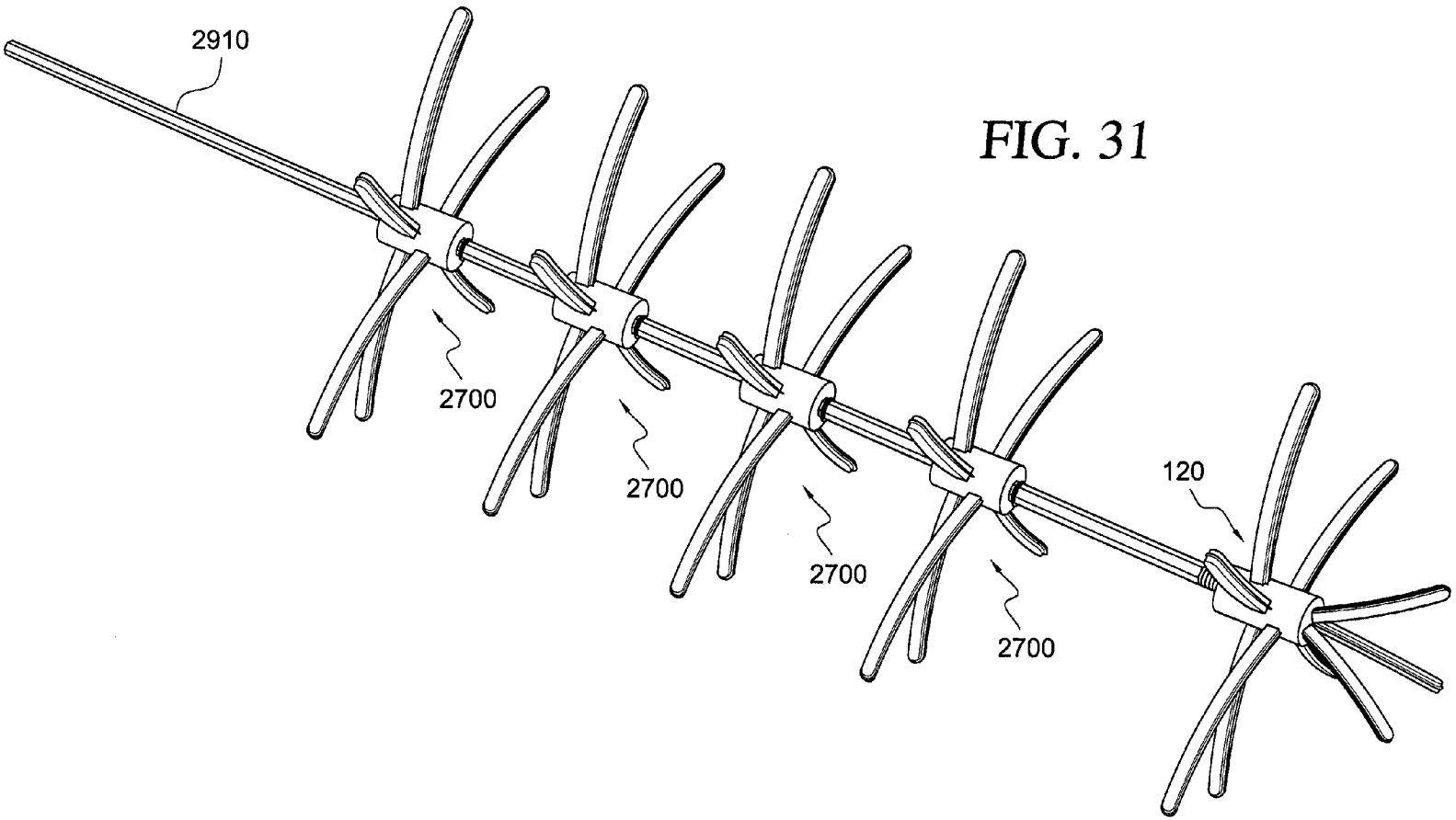
FIG. 31 is a side perspective view of the stirrer tool of FIGS. 29 and 30 showing an assembled unit including the stirrer head and multiple intermediary finger assemblies on the rod, in accordance with an embodiment of the present invention.

FIG. 31 is a side perspective view of the stirrer tool of FIGS. 29 and 30 showing an assembled unit including the stirrer head and multiple intermediary finger assemblies on the rod, in accordance with an embodiment of the present invention. In FIG. 31, four intermediary finger assemblies 2700 are affixed along the length of rod 2910 with circlip/"E"-clip/"C"-clips 3010 inserted into grooves 2920 to prevent the four intermediary finger assemblies 2700 from moving distally toward stirrer tool 120.

Figure 32:
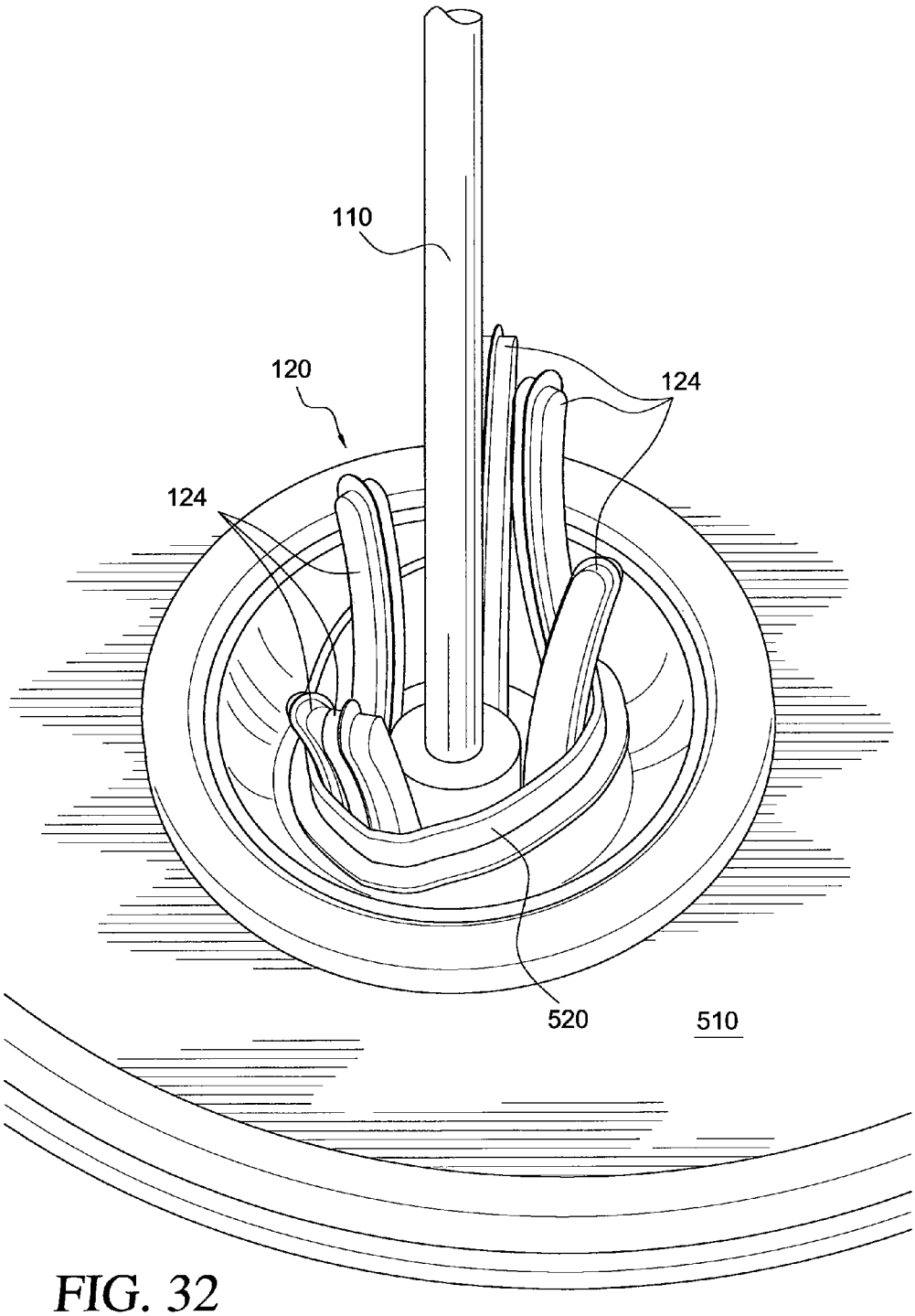
FIG. 32 is a top perspective view of the five-gallon paint can and the stirrer tool from FIG. 6 showing the fingers on the stirrer tool folding back against the body of the head of the stirrer tool as the stirrer tool is inserted into the can through the pour spout in a top of the can, in accordance with an embodiment of the present invention.

FIG. 32 is a top perspective view of the five-gallon paint can and stirrer tool 120 showing first plurality of projections 124 on stirrer tool 120 folding back against the body of the head of stirrer tool 120 and pointing toward a proximal end of and substantially parallel with rod 110 as stirrer tool 120 is inserted into the can through pour spout 520 in top of can 510, in accordance with an embodiment of the present invention.

Figure 33:
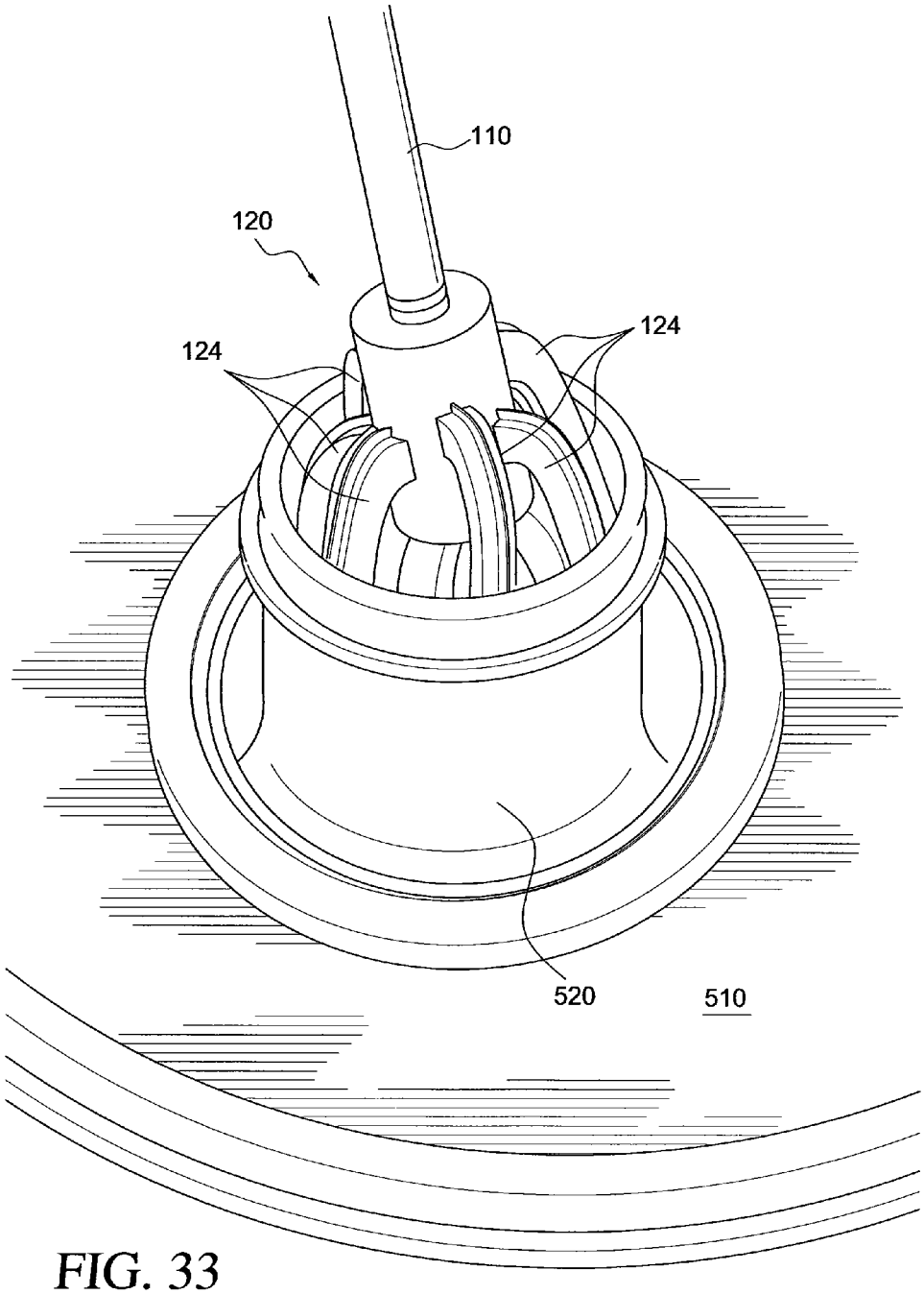
FIG. 33 is a top perspective view of the five-gallon paint can and stirrer tool of FIGS. 9 and 10 with the stirrer tool being removed from the paint can and showing the fingers on the head of the stirrer being folded against the body of the stirrer as the head is being withdrawn through the pouring spout of the five-gallon paint can, in accordance with an embodiment of the present invention.

FIG. 33 is a top perspective view of the five-gallon paint can and stirrer tool of FIG. 32 with stirrer tool 120 being removed from the paint can and showing first plurality of projections 124 on the head of stirrer tool 120 being folded against the body of stirrer tool 120 and pointing toward a distal end of and substantially parallel with rod 110 as the head is being withdrawn through pour spout 520 in top of can 510, in accordance with an embodiment of the present invention.

Figure 34:
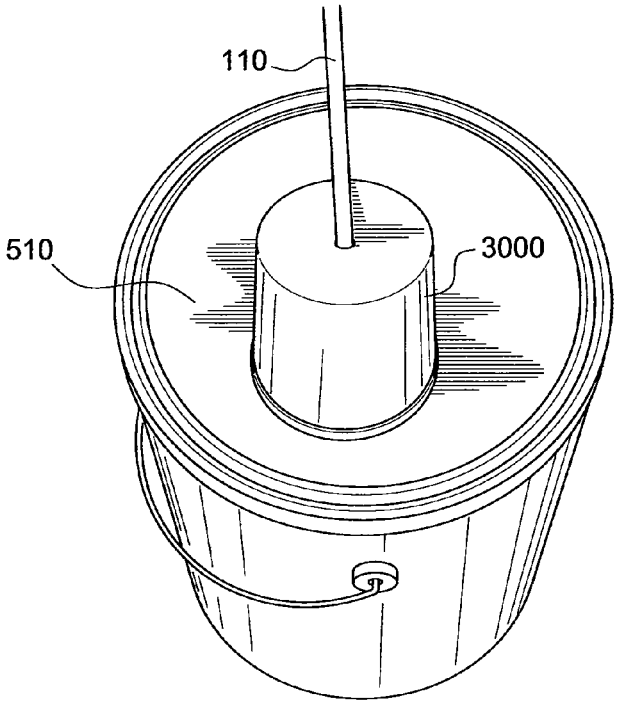
FIG. 34 is a close-up of the top/side perspective view of the five-gallon paint can and stirrer tool of FIG. 14 with the retrieval/removal component against the top of the paint can and over the pouring spout in preparation of the removal of the stirrer tool from the five-gallon paint can, in accordance with an embodiment of the present invention.

FIG. 34 is a close-up of the top/side perspective view of five-gallon paint can 510 and stirrer tool 120 inside of and hidden from view by a retrieval/removal component 3000 on rod 110 and against the top of the paint can and over pour spout 520 in position to receive stirrer tool 120 as it is removed through top of can 510, in accordance with an embodiment of the present invention.

Figure 35:
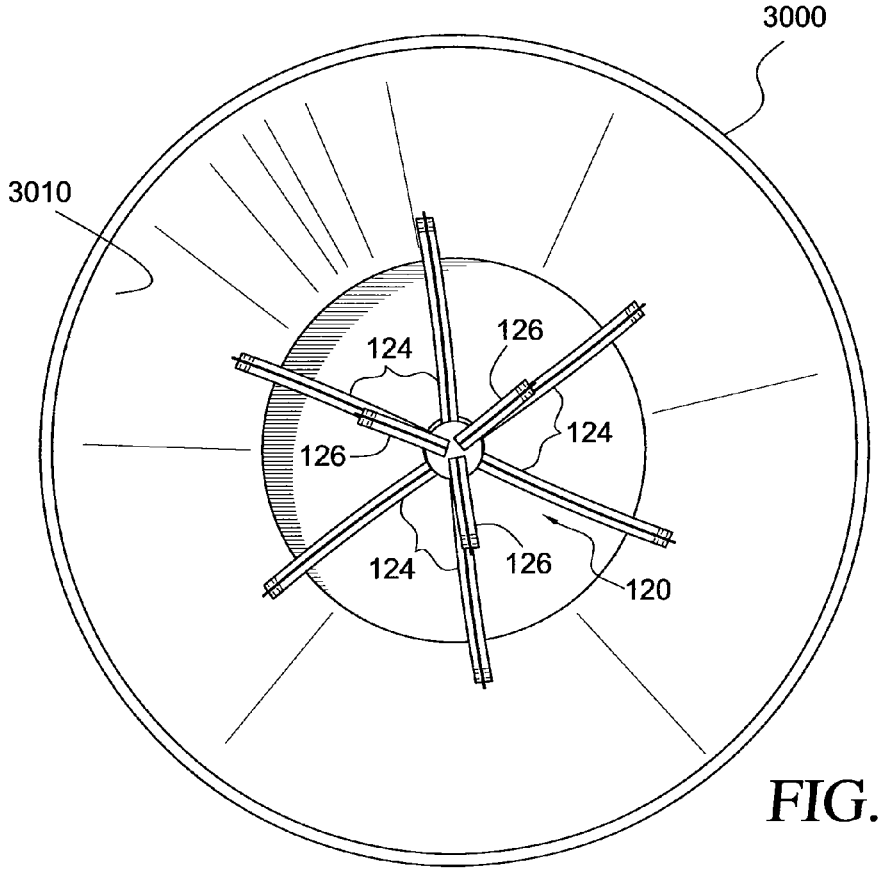
FIG. 35 is a top view of the retrieval/removal component and stirrer tool of FIG. 15 with the stirrer tool being surrounded by the retrieval/removal component such that the fingers of the stirrer tool are engaged against and held by an inner wall of the retrieval/removal component, in accordance with an embodiment of the present invention.

FIG. 35 is a top view of the inside of retrieval/removal component 3000 with stirrer tool 120 within and surrounded by an inner wall 3010 of retrieval/removal component 3000 such that each of fingers 124 of stirrer tool 120 are engaged against and held by inner wall 3010, in accordance with an embodiment of the present invention.

Figure 36:
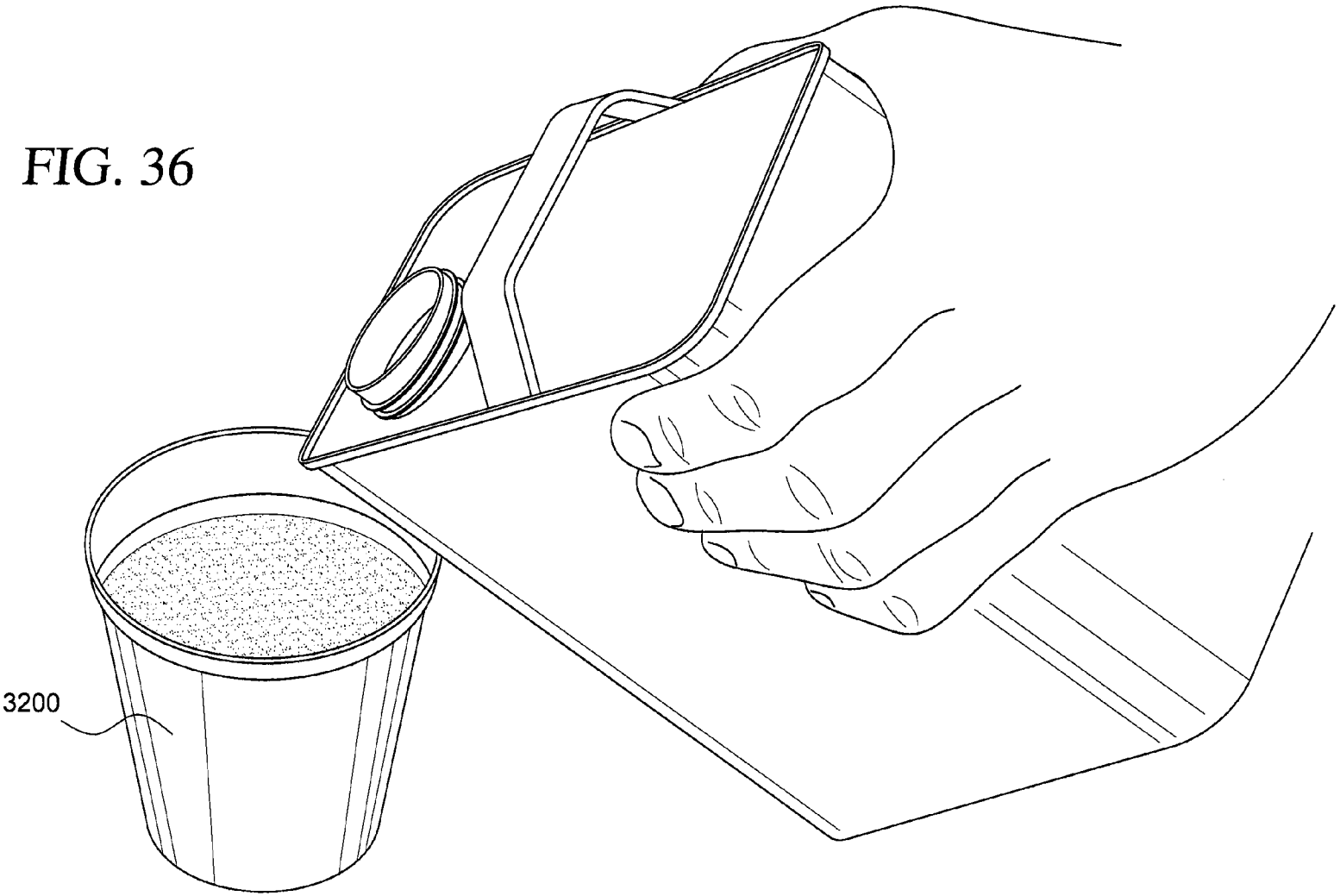
FIG. 36 is a top perspective view of a small container containing an amount of paint and into which a thinner or reducer is being added, in accordance with an embodiment of the present invention.

FIG. 36 is a top perspective view of a small container 3200 containing an amount of paint and into which a thinner or reducer is being added in preparation for mixing of the paint and thinner, in accordance with an embodiment of the present invention.

Figure 37:
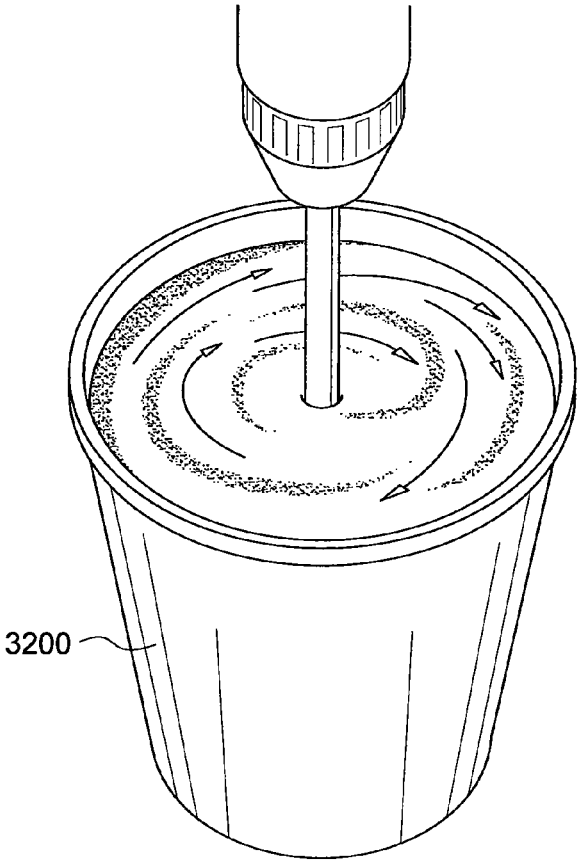
FIG. 37 is a top perspective view of the small container and an another stirrer tool of FIG. 36 fastened into a cordless electric drill showing the vortex mixing action imparted to the paint and thinner/reducer mixture by the operation of the stirrer tool in the small container, in accordance with an embodiment of the present invention.

FIG. 37 is a top perspective view of small container 3200 of FIG. 32 and an another stirrer tool fastened into a cordless electric drill showing the vortex mixing action imparted to the paint and thinner/reducer mixture by the operation of the stirrer tool in the small container, in accordance with an embodiment of the present invention.

Figure 38:
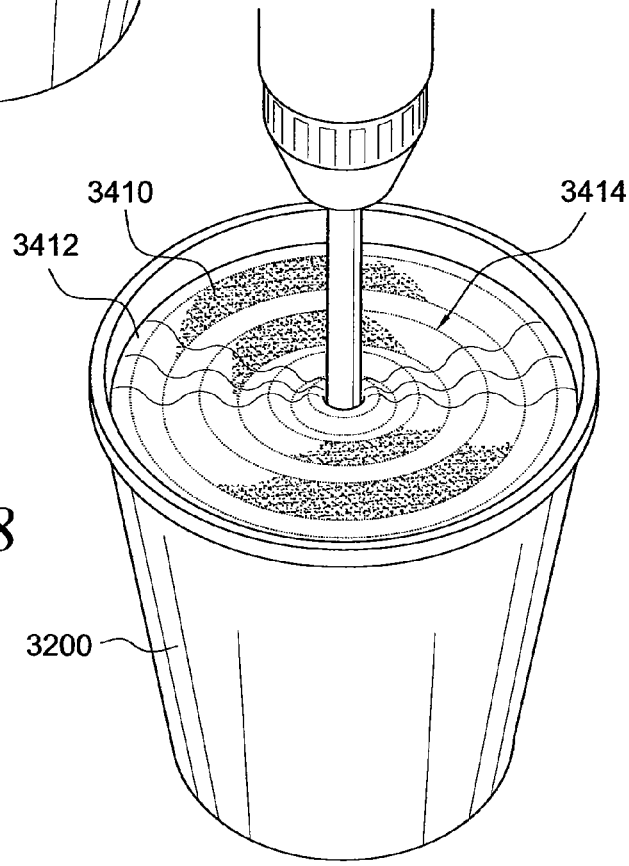
FIG. 38 is a top perspective view of the small container and another stirrer tool fastened into the cordless electric drill of FIG. 37 showing another mixing action that may be imparted to the paint and thinner/reducer mixture by the operation of the stirrer tool in the small container, in accordance with an embodiment of the present invention.

FIG. 38 is a top perspective view of small container 3200 and another stirrer tool fastened into the cordless electric drill of FIG. 37 showing another mixing action that may be imparted to a liquid 3410, for example, the paint and thinner/reducer mixture of FIG. 36, by the operation of the stirrer tool in the small container, in accordance with an embodiment of the present invention. In FIG. 38, a top surface 3412 of liquid 3410 is shown to have ripples 3414 substantially evenly distributed across top surface 3412. Operating stirrer head 120 against an inner wall and/or bottom surface of small container 3200 may produce ripples 3414.

Figure 39:
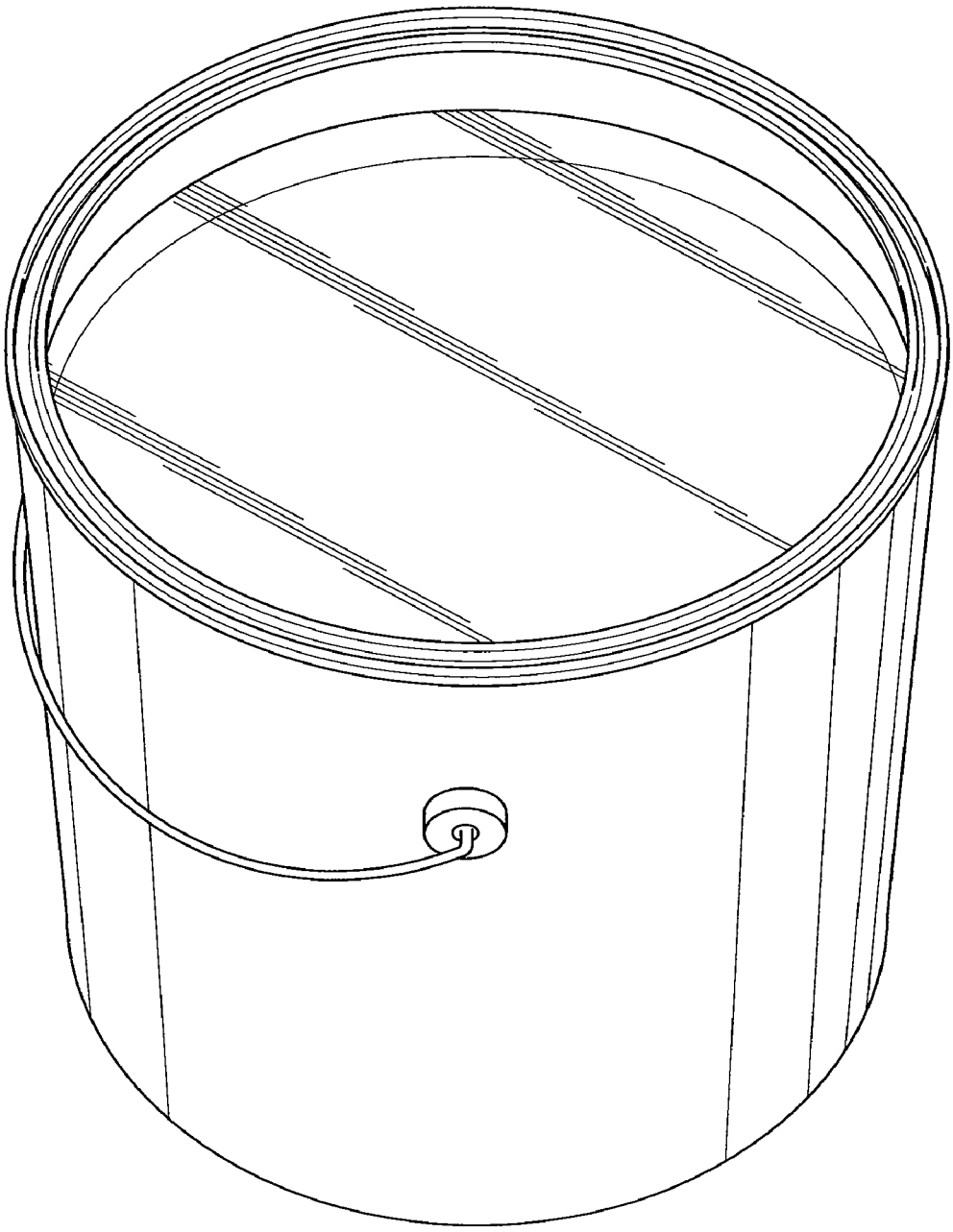
FIG. 39 is a top perspective view of a container with a separated liquid, for example, but not limited to, a paint portion, seen as the white lower portion, and a clear water/thinner/reducer layer on top of the white lower portion suitable for use with embodiments of the present invention.

FIG. 39 is a top perspective view of a container with a separated liquid, for example, but not limited to, a paint portion, seen as the white lower portion, and a clear water/thinner/reducer layer on top of the white lower portion suitable for use with embodiments of the present invention.

Figure 40:
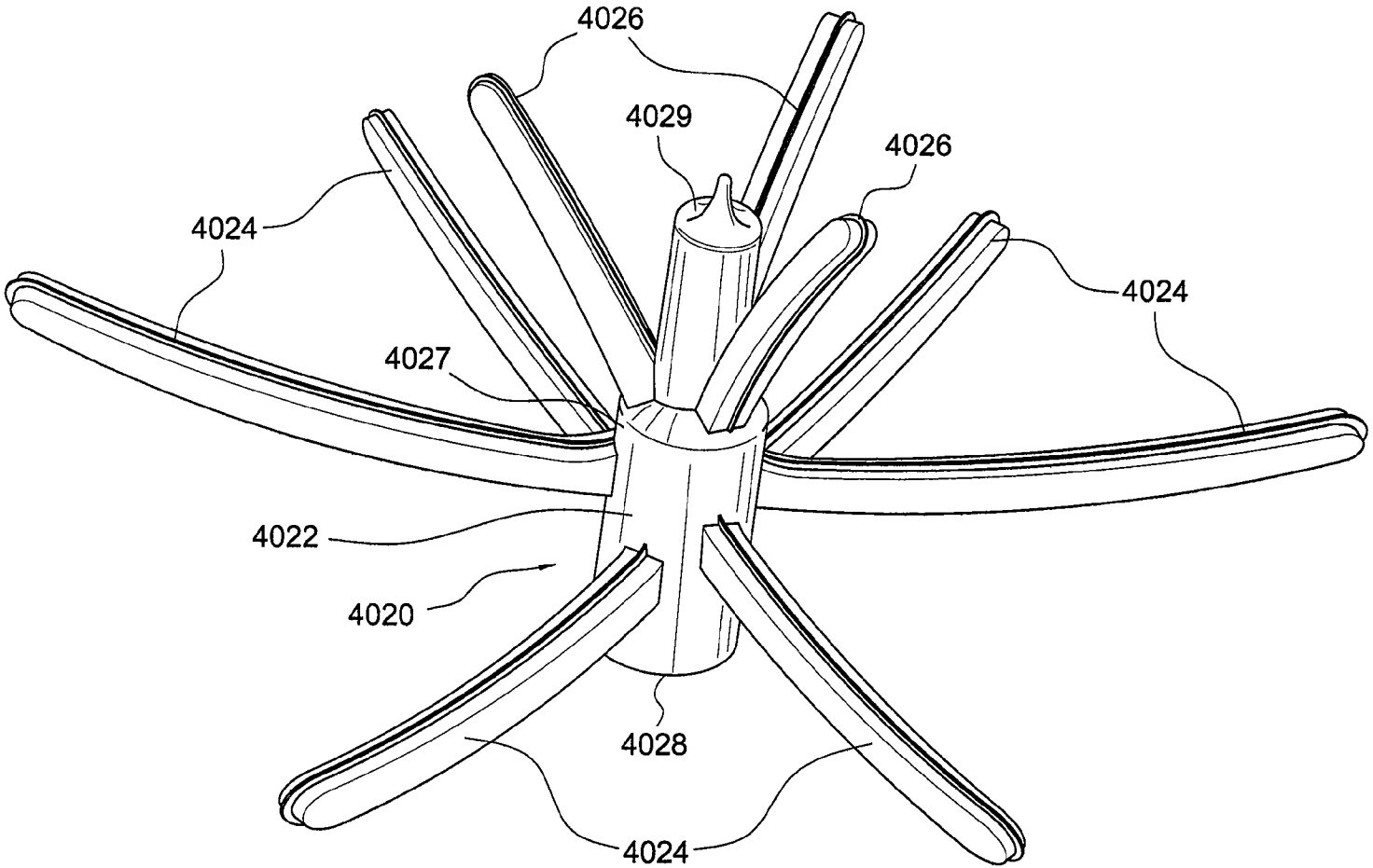
FIG. 40 is a side perspective view of a stirrer head, in accordance with another embodiment of the present invention.

FIG. 40 is a side perspective view of a stirrer head, in accordance with another embodiment of the present invention. In FIG. 40, a stirrer head 4020 may include a first body portion 4022 having a longitudinal axis, a second body portion 4029 connected to and coaxially aligned along the longitudinal axis with first body portion 4022, a first plurality of projections 4024 and a second plurality of projections 4026. For example, in the embodiment of FIG. 40, first plurality of projections 4024 may include three levels of substantially opposite projections that are, generally, evenly spaced around first body portion 4022 and extend substantially radially outwardly from an outer surface of first body portion 4022 and substantially perpendicular to the longitudinal axis of first body portion 4022. First body portion 4022 may also include a second plurality of projections 4026 extending in a substantially distal direction away from a distal end 4027 of first body portion 4022 and arranged around and near where a proximal end of second body portion 4029 connects with the distal end of first body portion 4022. Second body portion 4029 operates to prevent the distal end of first body portion 4022 from touching the bottom of any container into which stirrer head 4020 may be pushed. This configuration prevents second plurality of projections 4026 from being smashed flat into and rubbing against the bottom of a container when in use, which could result in some or all of the second plurality of projections 4026 being worn or broken away. The projections may be made of, for example, but not limited to, a substantially stiff monofilament and/or an injection molded plastic and/or plastic compound/composite, that is also flexible enough to be bent to fit through an opening in a container that is smaller in diameter than a diameter of stirrer head 4020 as defined by outer ends of first plurality of projections 4024 and stiff enough to mix viscous products.

In FIG. 40, each of the first plurality of projections 4024 and each of second plurality of projections 126 may have lengths ranging from ½ inch to 3 inches or longer, depending on the size of the container and viscosity of the liquid in the container to be mixed. The projections may be tailored, for example, shortened by cutting off a selected length of the monofilament, and first plurality of projections 4024 may be configured to provide a vortex mixing action and second plurality of projections 4026 may be configured to reach and stir up sediment on bottoms and in corners in containers. Because different containers may have different sizes and openings, the ultimate diameter of head unit 4020 may be variable, for example, for a standard one-gallon paint can and/or for use through a spout in a five-gallon or larger can a head unit 4020 with projections of approximately 3 inches may be used to fit through the openings and leave room between the outside ends of the projections and an inner wall of the can. Likewise, for an open-top five-gallon or larger can the projections may be sized to fit through the open tops of the cans and leave room between the outside ends of the projections and an inner wall of the can. For example, if a can has an inner side wall diameter of 10 inches, the diameter of the head unit when measured from the tips of opposite projections would be less than 10 inches, for example, but not limited to, 8 inches, to permit the free rotation of the head unit within the liquid in the can to produce the vortex mixing action. Additional considerations to take into account when sizing the projections, may include the viscosity of the liquid to be mixed and the power of the device used to rotate the stirrer tool within the liquid. A distal end of a rod (not shown, but which could include rod 110 from FIG. 1) may be attached to a proximal end 4028 of body portion 4022, for example, but not limited to, by screwing the distal end of the rod into proximal end 4028.

In accordance with an embodiment of the present invention, a stirrer tool system may include a head component including a body portion having a longitudinal axis, a first plurality of projections extending substantially radially out from an outer surface of the body portion and being substantially perpendicular to the longitudinal axis of the body portion, and a second plurality of projections extending in a substantially distal direction away from a distal end of the body portion. The projections being made of a substantially stiff material that is flexible enough to be bent to fit through an opening in a container that is smaller in diameter than a diameter of the head component defined by outer ends of the first plurality of projections and stiff enough to mix viscous products. Each projection also being capable of being shortened by cutting off a selected length of the projection, the first plurality of projections configured to provide a vortex mixing action and the second plurality of projections configured to reach and stir up sediment on bottoms and in corners in containers. The stirrer tool further includes an elongate shaft including a distal end and a proximal end, the elongate shaft being coaxially aligned with and the distal end of the elongate shaft being attached to the head component and the proximal end of the elongate shaft being configured to be removably held in a device to rotate the elongate shaft. The stirrer tool still further includes a splash prevention component configured to be coaxially aligned with the elongate shaft to permit movement of the splash prevention component longitudinally along the elongate shaft and to completely cover, receive and hold the head component upon removal of the head component from a container to prevent splashing of any material from the head component onto a user of the system.

In accordance with an embodiment of the present invention, a stirrer tool system may include a head means including a body means having a longitudinal axis, a first plurality of projection means extending substantially radially out from an outer surface of the body portion and being substantially perpendicular to the longitudinal axis of the body portion, and a second plurality of projection means extending in a substantially distal direction away from a distal end of the body portion. The projection means may be made of a substantially stiff material that is flexible enough to be bent to fit through an opening in a container that is smaller in diameter than a diameter of the head component defined by outer ends of the first plurality of projections and stiff enough to mix viscous products. Each of the first and second projection means may be shortened by cutting-off a selected length of the projection means, and the first plurality of projection means may be configured to provide a vortex mixing action and the second plurality of projection means configured to reach and stir up sediment on bottoms and in corners in containers. The stirring means may further include an elongate shaft means including a distal end and a proximal end, the elongate shaft means being coaxially aligned with and the distal end of the elongate shaft means being attached to the head means and the proximal end of the elongate shaft means may be configured to be removably held in a device to rotate the elongate shaft.

In accordance with an embodiment of the present invention, a method of stirring a liquid within a container may include using a stirrer tool having a head component including a body portion having a longitudinal axis, a first plurality of projections extending substantially radially out from an outer surface of the body portion and being substantially perpendicular to the longitudinal axis of the body portion, and a second plurality of projections extending in a substantially distal direction away from a distal end of the body portion. The projections may be made of a substantially stiff material that is flexible enough to be bent to fit through an opening in a container that is smaller in diameter than a diameter of the head component defined by outer ends of the first plurality of projections and stiff enough to mix viscous products. The method may further include attaching the head component to an elongate shaft including a distal end and a proximal end, the elongate shaft being coaxially aligned with and the distal end of the elongate shaft being attached to the head component. The method may further include fastening the proximal end of the elongate shaft in a device to rotate the elongate shaft, inserting at least the head component into a liquid in a container, and rotating the stirrer tool using the device to rotate the elongate shaft to mix the liquid in the container.

The method may optionally include mixing the liquid with the first plurality of projections configured to provide a vortex mixing action and the second plurality of projections configured to reach and stir up sediment on bottoms and in corners in containers. The method may optionally include selectively shortening one or more of the first and second projections by cutting-off a selected length of the projection, and the first plurality of projections may be configured to provide a vortex mixing action and the second plurality of projections configured to reach and stir up sediment on bottoms and in corners in containers.

In accordance with an embodiment of the present invention, a stirrer tool system may include a head component including a body portion having a longitudinal axis, a first plurality of projections extending substantially radially out from an outer surface of the body portion and being substantially perpendicular to the longitudinal axis of the body portion, and a second plurality of projections extending in a substantially distal direction away from a distal end of the body portion. The projections being made of a substantially stiff material that is flexible enough to be bent to fit through an opening in a container that is smaller in diameter than a diameter of the head component defined by outer ends of the first plurality of projections and stiff enough to mix viscous products. Each of the projections being capable of being shortened by cutting off a selected length of the projection, the first plurality of projections configured to provide a vortex mixing action and the second plurality of projections configured to reach and stir up sediment on bottoms and in corners in containers; an elongate shaft including a distal end and a proximal end, the elongate shaft being coaxially aligned with and the distal end of the elongate shaft being attached to the head component and the proximal end of the elongate shaft being configured to be removably held in a device to rotate the elongate shaft. The system further includes an intermediary finger component coaxially aligned with and affixed to the elongate shaft proximal to the head component. The system still further includes a splash prevention component configured to be coaxially aligned with the elongate shaft to permit movement of the splash prevention component longitudinally along the elongate shaft and to completely cover, receive and hold the head component upon removal of the head component from a container to prevent splashing of any material from the head component onto a user of the system.

In accordance with an embodiment of the present invention, a stirrer tool system may include a head means including a body means having a longitudinal axis, a first plurality of projection means extending substantially radially out from an outer surface of the body means and being substantially perpendicular to the longitudinal axis of the body means, and a second plurality of projection means extending in a substantially distal direction away from a distal end of the body means, the projection means being made of a substantially stiff material that is flexible enough to be bent to fit through an opening in a container that is smaller in diameter than a diameter of the head means defined by outer ends of the first plurality of projection means and stiff enough to mix viscous products, each projection means being capable of being shortened by cutting off a selected length of the projection means, the first plurality of projection means configured to provide a vortex mixing action and the second plurality of projection means configured to reach and stir up sediment on bottoms and in corners in containers. The stirring means may further include an elongate shaft means including a distal end and a proximal end, the elongate shaft means being coaxially aligned with and the distal end of the elongate shaft means being attached to the head means and the proximal end of the elongate shaft means being configured to be removably held in a device to rotate the elongate shaft means. The stirring means still further including a splash prevention means configured to be coaxially aligned with the elongate shaft means to permit movement of the splash prevention means longitudinally along the elongate shaft means and to completely cover, receive and hold the head means upon removal of the head means from a container to prevent splashing of any material from the head means onto a user of the system.

A method for stirring a liquid using a stirrer tool system including a head component including a body portion having a longitudinal axis, a first plurality of projections extending substantially radially out from an outer surface of the body portion and being substantially perpendicular to the longitudinal axis of the body portion, and a second plurality of projections extending in a substantially distal direction away from a distal end of the body portion, the projections being made of a substantially stiff material that is flexible enough to be bent to fit through an opening in a container that is smaller in diameter than a diameter of the head component defined by outer ends of the first plurality of projections and stiff enough to mix viscous products, each projection being capable of being shortened by cutting off a selected length of the projection, the first plurality of projections configured to provide a vortex mixing action and the second plurality of projections configured to reach and stir up sediment on bottoms and in corners in containers; an elongate shaft including a distal end and a proximal end, the elongate shaft being coaxially aligned with and the distal end of the elongate shaft being attached to the head component and the proximal end of the elongate shaft being configured to be removably held in a device to rotate the elongate shaft; and a splash prevention component configured to be coaxially aligned with the elongate shaft to permit movement of the splash prevention component longitudinally along the elongate shaft and to completely cover, receive and hold the head component upon removal of the head component from a container to prevent splashing of any material from the head component onto a user of the system. The method may include fastening the head component to the distal end of the elongate shaft; fastening the proximal end of the elongate shaft to the device; inserting at least the head component into the material, for example, a liquid, in the container, using the device to rotate the elongate shaft and head component to mix the liquid, and removing the head component from the liquid. The method may optionally include removing the head component from the liquid and the container directly into the splash prevention component to prevent any of the liquid from splashing/flying off the head component and on to the user or area surrounding the container.

In accordance with an embodiment of the present invention, a stirrer tool system may include a head means including a body means having a longitudinal axis, a first plurality of projection means extending substantially radially out from an outer surface of the body means and being substantially perpendicular to the longitudinal axis of the body means, and a second plurality of projection means extending in a substantially distal direction away from a distal end of the body means, the projection means being made of a substantially stiff material that is flexible enough to be bent to fit through an opening in a container that is smaller in diameter than a diameter of the head means defined by outer ends of the first plurality of projection means and stiff enough to mix viscous products, each projection means being capable of being shortened by cutting off a selected length of the projection means, the first plurality of projection means configured to provide a vortex mixing action and the second plurality of projection means configured to reach and stir up sediment on bottoms and in corners in containers; an elongate shaft means including a distal end and a proximal end, the elongate shaft means being coaxially aligned with and the distal end of the elongate shaft means being attached to the head means and the proximal end of the elongate shaft means being configured to be removably held in a device means to rotate the elongate shaft means; an intermediary finger means coaxially aligned with and affixed to the elongate shaft means proximal to the head means; and a splash prevention means configured to be coaxially aligned with the elongate shaft means to permit movement of the splash prevention means longitudinally along the elongate shaft means and to completely cover, receive and hold the head means upon removal of the head means from a container to prevent splashing of any material from the head means onto a user of the system.

A method for stirring a liquid using a stirrer tool system including a head component including a body portion having a longitudinal axis, a first plurality of projections extending substantially radially out from an outer surface of the body portion and being substantially perpendicular to the longitudinal axis of the body portion, and a second plurality of projections extending in a substantially distal direction away from a distal end of the body portion, the projections being made of a substantially stiff material that is flexible enough to be bent to fit through an opening in a container that is smaller in diameter than a diameter of the head component defined by outer ends of the first plurality of projections and stiff enough to mix viscous products, each projection being capable of being shortened by cutting off a selected length of the projection, the first plurality of projections configured to provide a vortex mixing action and the second plurality of projections configured to reach and stir up sediment on bottoms and in corners in containers; an elongate shaft including a distal end and a proximal end, the elongate shaft being coaxially aligned with and the distal end of the elongate shaft being attached to the head component and the proximal end of the elongate shaft being configured to be removably held in a device to rotate the elongate shaft; an intermediary finger component coaxially aligned with and affixed to the elongate shaft proximal to the head component; and a splash prevention component configured to be coaxially aligned with the elongate shaft to permit movement of the splash prevention component longitudinally along the elongate shaft and to completely cover, receive and hold the head component upon removal of the head component from a container to prevent splashing of any material from the head component onto a user of the system. The method may include fastening the head component to the distal end of the elongate shaft; fastening the proximal end of the elongate shaft to the device; fastening at least one intermediary finger component to the elongate shaft; inserting at least the head component into the material, for example, a liquid, in the container, using the device to rotate the elongate shaft and head component to mix the liquid, and removing the head component from the liquid. The method may optionally include removing the head component from the liquid and the container directly into the splash prevention component to prevent any of the liquid from splashing/flying off the head component and on to the user or area surrounding the container.

In accordance with an embodiment of the present invention, a stirrer tool including a head component including a first body portion having a proximal end, a distal end, a first diameter, a first length and a longitudinal axis, the head component further including a second body portion coaxially aligned with the first body portion along the longitudinal axis and the second body portion having a proximal end, a distal end, a second diameter smaller than the first diameter, a proximal end and a second length shorter than the first length of the first body portion, the proximal end of the second body portion being connected to the distal end of the first body portion. The stirrer tool may further include a first plurality of projections extending substantially radially out from an outer surface of the body portion and being substantially perpendicular to the longitudinal axis of the body portion. The stirrer tool may still further include a second plurality of projections being arranged substantially evenly on and extending in a substantially distal direction away from the distal end of the first body portion. In the stirrer tool each of the projections may be made of a substantially stiff material that is flexible enough to be bent to fit through an opening in a container that is smaller in diameter than a diameter of the head component defined by outer ends of the first plurality of projections and stiff enough to mix viscous products, each projection being capable of being shortened by cutting off a selected length of the projection, the first plurality of projections configured to provide a vortex mixing action and the second plurality of projections configured to extend beyond reach and stir up sediment on bottoms and in corners in containers.

In accordance with yet another embodiment of the present invention, a stirrer tool system including a head component including a first body portion having a proximal end, a distal end, a first diameter, a first length and a longitudinal axis, the head component further including a second body portion coaxially aligned with the first body portion along the longitudinal axis and the second body portion having a proximal end, a distal end, a second diameter smaller than the first diameter, a proximal end and a second length shorter than the first length of the first body portion, the proximal end of the second body portion being connected to the distal end of the first body portion. The stirrer tool system may further include a first plurality of projections extending substantially radially out from an outer surface of the body portion and being substantially perpendicular to the longitudinal axis of the body portion. The stirrer tool system may still further include a second plurality of projections being arranged substantially evenly on and extending in a substantially distal direction away from the distal end of the first body portion. In the stirrer tool system each of the projections may be made of a substantially stiff material that is flexible enough to be bent to fit through an opening in a container that is smaller in diameter than a diameter of the head component defined by outer ends of the first plurality of projections and stiff enough to mix viscous products, each projection being capable of being shortened by cutting off a selected length of the projection, the first plurality of projections configured to provide a vortex mixing action and the second plurality of projections configured to extend beyond reach and stir up sediment on bottoms and in corners in containers. The stirrer tool system may still further include an elongate shaft including a distal end and a proximal end, the elongate shaft being coaxially aligned with and the distal end of the elongate shaft being attached to the head component and the proximal end of the elongate shaft being configured to be removably held in a device to rotate the elongate shaft. The stirrer tool system may still further include a splash prevention component configured to be coaxially aligned with the elongate shaft to permit movement of the splash prevention component longitudinally along the elongate shaft and to completely cover, receive and hold the head component upon removal of the head component from a container to prevent splashing of any material from the head component onto a user of the system.

In accordance with yet another embodiment of the present invention, a stirrer tool system including a head component including a first body portion having a proximal end, a distal end, a first diameter, a first length and a longitudinal axis, the head component further including a second body portion coaxially aligned with the first body portion along the longitudinal axis and the second body portion having a proximal end, a distal end, a second diameter smaller than the first diameter, a proximal end and a second length shorter than the first length of the first body portion, the proximal end of the second body portion being connected to the distal end of the first body portion. The stirrer tool system may further include a first plurality of projections extending substantially radially out from an outer surface of the body portion and being substantially perpendicular to the longitudinal axis of the body portion. The stirrer tool system may still further include a second plurality of projections being arranged substantially evenly on and extending in a substantially distal direction away from the distal end of the first body portion. In the stirrer tool system each of the first and second pluralities of projections being made of a substantially stiff material that is flexible enough to be bent to fit through an opening in a container that is smaller in diameter than a diameter of the head component defined by outer ends of the first plurality of projections and stiff enough to mix viscous products, each projection being capable of being shortened by cutting off a selected length of the projection, the first plurality of projections configured to provide a vortex mixing action and the second plurality of projections configured to extend beyond reach and stir up sediment on bottoms and in corners in containers. The stirrer tool system may still further include an elongate shaft including a distal end and a proximal end, the elongate shaft being coaxially aligned with and the distal end of the elongate shaft being attached to the head component and the proximal end of the elongate shaft being configured to be removably held in a device to rotate the elongate shaft. The stirrer tool system may still further include an intermediary finger component coaxially aligned with and affixed to the elongate shaft proximal to the head component. The stirrer tool system may still further include a splash prevention component configured to be coaxially aligned with the elongate shaft to permit movement of the splash prevention component longitudinally along the elongate shaft and to completely cover, receive and hold the head component upon removal of the head component from a container to prevent splashing of any material from the head component onto a user of the system.

One or more embodiments of the present invention include the apparatus, tool, and system substantially as shown and described. Additionally, in other embodiments of the present invention, every element can be separately and individually claimed.

As is apparent from the above description and the figures referenced therein, there is provided a variety of embodiments of a stirrer tool, intermediary finger assembly and stirrer tool system, in accordance with the present invention. While this invention has been described in conjunction with a number of embodiments, it is evident that many alternatives, modifications and variations would be, or are, apparent to those of ordinary skill in the applicable arts. Accordingly, applicant intends to embrace all such alternatives, modifications, equivalents and variations that are within the spirit and scope of this invention.

What is claimed is:

1. A stirrer tool comprising:

a head component including a first body portion having a proximal end, a distal end, a first diameter, a first length and a longitudinal axis, the head component further including a second body portion coaxially aligned with the first body portion along the longitudinal axis and the second body portion having a proximal end, a distal end, a second diameter smaller than the first diameter, a proximal end and a second length shorter than the first length of the first body portion, the proximal end of the second body portion being connected to the distal end of the first body portion;

a first plurality of projections extending substantially radially out from an outer surface of the first body portion and being substantially perpendicular to the longitudinal axis of the first body portion; and a second plurality of projections being arranged substantially evenly on and extending in a substantially distal direction away from the distal end of the first body portion;

each of the projections being made of a substantially stiff material that is flexible enough to be bent to fit through an opening in a container that is smaller in diameter than a diameter of the head component defined by outer ends of the first plurality of projections and stiff enough to mix viscous products, each projection being capable of being shortened by cutting off a selected length of the projection, the first plurality of projections configured to provide a vortex mixing action and the second plurality of projections configured to extend beyond reach and stir up sediment on bottoms and in corners in containers.

2. The stirrer tool of claim 1 further comprising an elongate shaft having a distal end and a proximal end, the elongate shaft being coaxially aligned with and the distal end of the elongate shaft being attached to the head component and the proximal end of the elongate shaft being configured to be removably held in a device to rotate the elongate shaft.

3. The stirrer tool of claim 2 wherein the head component further comprises a channel to be removably attached to threads on the distal end of the elongate shaft.

4. The stirrer tool of claim 2 wherein the head component is manufactured as a single component by injection molding and the head component is configured to be permanently attached to the distal end of the elongate shaft.

5. The stirrer tool of claim 2 wherein the head component is configured to be removably attached to the distal end of the elongate shaft.

6. The stirrer tool of claim 2 further comprising an intermediary finger component coaxially aligned with and affixed to the elongate shaft proximal to the head component, the intermediary finger component including an intermediary body portion including a substantially cylindrical shape with an outer surface and an inner surface that defines a longitudinal passage running completely through the intermediary body portion and that defines openings at each end of the intermediary body portion, the longitudinal passage having an inner diameter of sufficient size to permit the elongate shaft to pass through the longitudinal passage, and an open-ended threaded passage running from the outer surface to the inner surface of the intermediary body portion so as to be substantially perpendicular to the longitudinal passage and a cooperatively threaded fastening element disposed in the open-ended threaded passage so that when the cooperatively threaded fastening element is threaded in toward the longitudinal passage a distal end of the cooperatively threaded fastening element is to extend into the longitudinal passage; and a third plurality of projections including a second at least three opposing pairs of projections that are evenly spaced around the outer surface of the intermediary body portion, where each of the second at least three opposing pairs of evenly spaced projections are attached to the intermediary body portion in separate planes perpendicular to the longitudinal axis of the intermediary body portion.

7. The stirrer tool of claim 6 wherein when the intermediary body portion has the elongated rod passing through the longitudinal passage and when the cooperatively threaded fastening element is threaded in toward the elongated rod in the longitudinal passage the distal end of the cooperatively threaded fastening element frictionally engages against a side of the elongated rod and fastens the intermediary body portion to the elongated rod.

8. The stirrer tool of claim 7 further comprising at least one more intermediary finger component coaxially aligned with and affixed to the elongate shaft proximal to the head component.

9. The stirrer tool of claim 1 wherein the first plurality of projections comprises at least three opposing pairs of projections that are substantially evenly spaced around the outer surface of the first body portion, where each of the at least three opposing pairs of substantially evenly spaced projections are attached to the first body portion in separate planes perpendicular to the longitudinal axis of the first body portion.

10. The stirrer tool of claim 9 wherein each of the at least three opposing pairs of projections comprise a continuous section that passes substantially perpendicularly through and is permanently attached to the first body portion.

11. The stirrer tool of claim 10 wherein the second plurality of projections comprises at least three projections of a predetermined length that are each individually and permanently attached to the distal end of the first body portion and are arranged around the proximal end of the second body portion.

12. The stirrer tool of claim 11 wherein each of the at least three projections comprises a section of material with a ⅛" to ½"-inch cross-section and a length in the range of from 1" to 3".

13. The stirrer tool of claim 9 wherein each of the at least three opposing pairs of projections comprise a pair of non-contiguous sections on substantially opposite sides of and that are each permanently attached to the first body portion.

14. The stirrer tool of claim 13 wherein the second plurality of projections comprises at least three projections of a predetermined length that are each individually and permanently attached to the distal end of the first body portion and are arranged around the proximal end of the second body portion.

15. The stirrer tool of claim 14 wherein each projection of each of the at least three opposing pairs of projections comprises a section of material with a ⅛" to ½"-inch cross-section and a length in the range of from 1" to 3".

16. The stirrer tool of claim 1 wherein the substantially stiff material comprises one of:

a monofilament;

a pre-formed plastic;

an injection molded plastic;

a pre-formed plastic compound; and an injection molded plastic compound.

17. A stirrer tool system comprising:

a head component including a first body portion having a proximal end, a distal end, a first diameter, a first length and a longitudinal axis, the head component further including a second body portion coaxially aligned with the first body portion along the longitudinal axis and the second body portion having a proximal end, a distal end, a second diameter smaller than the first diameter, a proximal end and a second length shorter than the first length of the first body portion, the proximal end of the second body portion being connected to the distal end of the first body portion;

a first plurality of projections extending substantially radially out from an outer surface of the first body portion and being substantially perpendicular to the longitudinal axis of the first body portion; and a second plurality of projections being arranged substantially evenly on and extending in a substantially distal direction away from the distal end of the first body portion;

each of the projections being made of a substantially stiff material that is flexible enough to be bent to fit through an opening in a container that is smaller in diameter than a diameter of the head component defined by outer ends of the first plurality of projections and stiff enough to mix viscous products, each projection being capable of being shortened by cutting off a selected length of the projection, the first plurality of projections configured to provide a vortex mixing action and the second plurality of projections configured to extend beyond reach and stir up sediment on bottoms and in corners in containers;

an elongate shaft including a distal end and a proximal end, the elongate shaft being coaxially aligned with and the distal end of the elongate shaft being attached to the head component and the proximal end of the elongate shaft being configured to be removably held in a device to rotate the elongate shaft; and a splash prevention component configured to be coaxially aligned with the elongate shaft to permit movement of the splash prevention component longitudinally along the elongate shaft and to completely cover, receive and hold the head component upon removal of the head component from a container to prevent splashing of any material from the head component onto a user of the system.

18. The stirrer tool system of claim 17 wherein the splash prevention component comprises a substantially frustoconical body including a distal end defining an opening with a diameter sufficient to cover the opening in the container and to accept the head component upon its withdrawal from the opening in the container.

19. The stirrer tool system of claim 18 wherein the diameter of the opening in the distal end of the splash prevention component is less than the diameter of the diameter of the head component defined by outer ends of the first plurality of projections.

20. The stirrer tool system of claim 18 wherein the splash prevention component is a plastic cup or container having a substantially frustoconical side wall that defines an opening at one end and an closed end opposite of the opening.

21. A stirrer tool system comprising:

a head component including a first body portion having a proximal end, a distal end, a first diameter, a first length and a longitudinal axis, the head component further including a second body portion coaxially aligned with the first body portion along the longitudinal axis and the second body portion having a proximal end, a distal end, a second diameter smaller than the first diameter, a proximal end and a second length shorter than the first length of the first body portion, the proximal end of the second body portion being connected to the distal end of the first body portion;

a first plurality of projections extending substantially radially out from an outer surface of the first body portion and being substantially perpendicular to the longitudinal axis of the first body portion; and a second plurality of projections being arranged substantially evenly on and extending in a substantially distal direction away from the distal end of the first body portion;

each of the first and second pluralities of projections being made of a substantially stiff material that is flexible enough to be bent to fit through an opening in a container that is smaller in diameter than a diameter of the head component defined by outer ends of the first plurality of projections and stiff enough to mix viscous products, each projection being capable of being shortened by cutting off a selected length of the projection, the first plurality of projections configured to provide a vortex mixing action and the second plurality of projections configured to extend beyond reach and stir up sediment on bottoms and in corners in containers;

an elongate shaft including a distal end and a proximal end, the elongate shaft being coaxially aligned with and the distal end of the elongate shaft being attached to the head component and the proximal end of the elongate shaft being configured to be removably held in a device to rotate the elongate shaft;

an intermediary finger component coaxially aligned with and affixed to the elongate shaft proximal to the head component; and a splash prevention component configured to be coaxially aligned with the elongate shaft to permit movement of the splash prevention component longitudinally along the elongate shaft and to completely cover, receive and hold the head component upon removal of the head component from a container to prevent splashing of any material from the head component onto a user of the system.

22. The stirrer tool system of claim 21 wherein the splash prevention component comprises a substantially frustoconical body including a distal end defining an opening with a diameter sufficient to cover the opening in the container and to accept the head component upon its withdrawal from the opening in the container.

23. The stirrer tool system of claim 22 wherein the diameter of the opening in the distal end of the splash prevention component is less than the diameter of the diameter of the head component defined by outer ends of the first plurality of projections.

24. The stirrer tool system of claim 22 wherein the splash prevention component is a plastic cup or container having a substantially frustoconical side wall that defines an opening at one end and an closed end opposite of the opening.

25. The stirrer tool system of claim 22 wherein the intermediary finger component comprises:

an intermediary body portion including a substantially cylindrical shape with an outer surface and an inner surface that defines a longitudinal passage running completely through the intermediary body portion and that defines openings at each end of the intermediary body portion, the longitudinal passage having an inner diameter of sufficient size to permit the elongate shaft to pass through the longitudinal passage, and an open-ended threaded passage running from the outer surface to the inner surface of the intermediary body portion so as to be substantially perpendicular to the longitudinal passage and a cooperatively threaded fastening element disposed in the open-ended threaded passage so that when the cooperatively threaded fastening element is threaded in toward the longitudinal passage a distal end of the cooperatively threaded fastening element is to extend into the longitudinal passage; and a third plurality of projections including a second at least three opposing pairs of projections that are evenly spaced around the outer surface of the intermediary body portion, where each of the second at least three opposing pairs of evenly spaced projections are attached to the intermediary body portion in separate planes perpendicular to the longitudinal axis of the intermediary body portion.

26. The stirrer tool system of claim 21 wherein the elongate shaft comprises:

a plurality of coaxially aligned circumferential grooves, where each groove is configured to engage a fastening means.

27. The stirrer tool system of claim 26 wherein the plurality of coaxially aligned circumferential grooves are substantially evenly spaced along elongate shaft.

28. The stirrer tool system of claim 26 wherein the fastening means comprises one or more of:

an "E"-clip;

a "C"-clip;

a spring clip;

a cotter pin;

a spring washer;

an "O"-ring;

a dowel pin; and a spring pin.

29. The stirrer tool system of claim 26 wherein the elongate shaft comprises one of:

a round rod having a predetermined length;

a square rod having a predetermined length;

a hexagonal rod having a predetermined length; and a a round rod having a predetermined length with at least a portion of an end of the round rod having a semi-circular cross-section.

* * * * *